US011470941B2

(12) United States Patent
Korba

(10) Patent No.: US 11,470,941 B2
(45) Date of Patent: Oct. 18, 2022

(54) COSMETIC COMPACT WITH REMOVABLE COSMETIC PANS

(71) Applicant: Gary Korba, New York, NY (US)

(72) Inventor: Gary Korba, New York, NY (US)

( * ) Notice: Subject to any disclaimer, the term of this patent is extended or adjusted under 35 U.S.C. 154(b) by 453 days.

(21) Appl. No.: 16/816,902

(22) Filed: Mar. 12, 2020

(65) Prior Publication Data

US 2020/0275757 A1 Sep. 3, 2020

Related U.S. Application Data

(63) Continuation-in-part of application No. 16/146,103, filed on Sep. 28, 2018, now Pat. No. 11,324,301.

(60) Provisional application No. 62/581,993, filed on Nov. 6, 2017.

(51) Int. Cl.

| | |
|---|---|
| ***A45D 27/22*** | (2006.01) |
| ***A45D 33/00*** | (2006.01) |
| ***A45D 40/22*** | (2006.01) |
| ***A45D 40/18*** | (2006.01) |
| ***A45D 42/04*** | (2006.01) |
| ***A45D 40/24*** | (2006.01) |

(52) U.S. Cl.

CPC ..... *A45D 33/008* (2013.01); *A45D 40/18* (2013.01); *A45D 40/22* (2013.01); *A45D 40/24* (2013.01); *A45D 42/04* (2013.01)

(58) Field of Classification Search

CPC .... A45D 33/00; A45D 33/003; A45D 33/005; A45D 33/008; A45D 33/006; A45D 33/08; A45D 33/10; A45D 40/18; A45D 40/22; A45D 40/24; A45D 40/221; A45D 2040/224; A45D 2040/225; A45C 11/008; A45C 13/002; A45C 5/005; B65D 2251/1016; B65D 2251/1025; B65D 2251/1033; B65D 2251/1083; B65D 2251/0053; B65D 43/161; B65D 43/16

USPC ..... 220/253, 839, 833–835

See application file for complete search history.

(56) References Cited

U.S. PATENT DOCUMENTS

| | | | | |
|---|---|---|---|---|
| 6,286,521 | B1 * | 9/2001 | Joulia | A45D 40/221 132/295 |
| 2009/0071867 | A1 * | 3/2009 | Au | A45D 40/24 220/520 |
| 2016/0075475 | A1 * | 3/2016 | Apodaca | A45D 40/26 220/6 |

* cited by examiner

*Primary Examiner* — Rachel R Steitz

(74) *Attorney, Agent, or Firm* — Tarter Krinsky & Drogin LLP

(57) ABSTRACT

A cosmetic compact including a hinge, the hinge including a spine having at least two extensions and at least two protrusions extending from the at least two extensions; a base, the base including at least two receivers and at least one opening configured to receive at least one pan; and a cover, wherein the cover and the base are connected to one another via the hinge. The spine having (1) a locked position wherein the extensions are configured to wrap around the base and the at least two protrusions are configured to be removably locked into the at least two receivers thereby securing the at least one pan within the at least one opening, and (2) an unlocked position wherein the at least two protrusions are configured to be removed from the at least two receivers thereby providing access to the at least one opening.

16 Claims, 25 Drawing Sheets

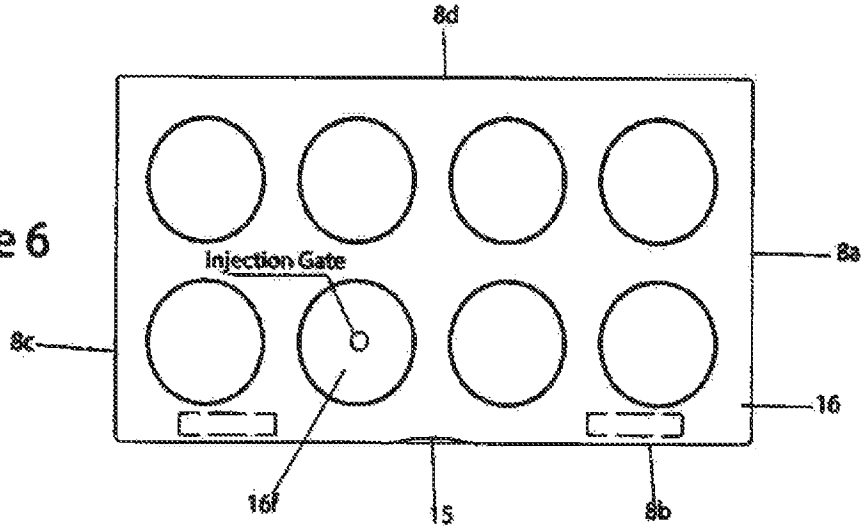
Figure 6
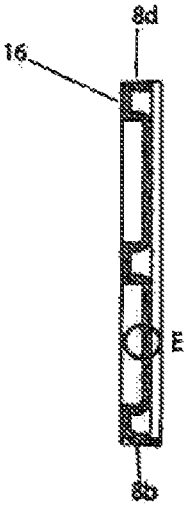
Figure 7
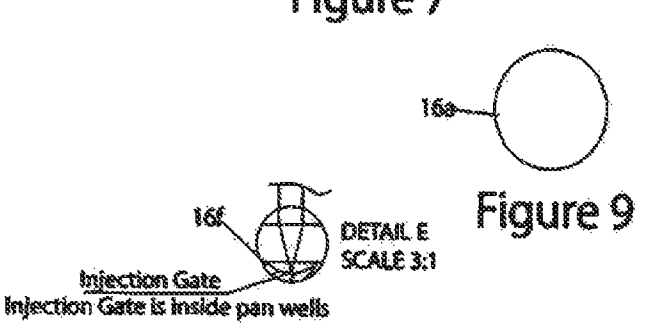
Figure 8
Figure 9
Figure 10
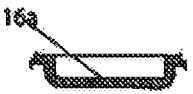
Figure 11

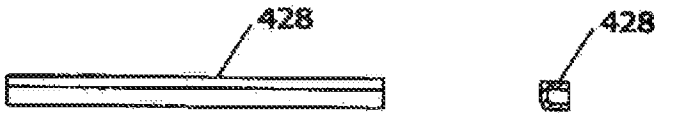
FIGURE 76
FIGURE 77
FIGURE 78
FIGURE 79
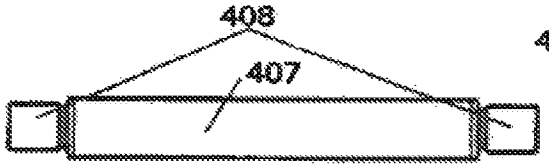
FIGURE 68
FIGURE 70
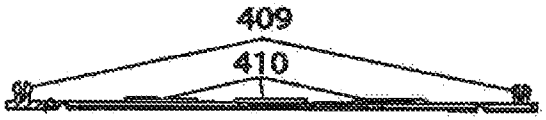
FIGURE 69
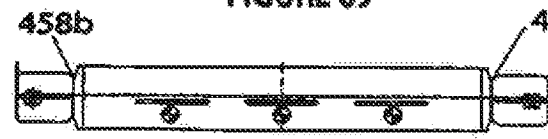
FIGURE 71
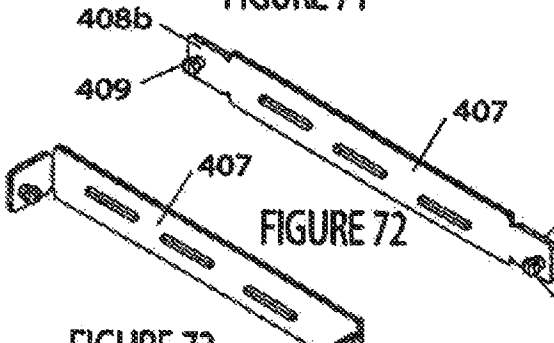
FIGURE 72
FIGURE 73
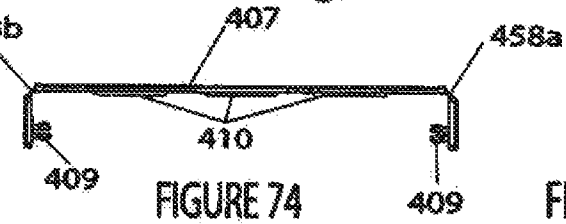
FIGURE 74
FIGURE 75

COSMETIC COMPACT WITH REMOVABLE COSMETIC PANS

CROSS REFERENCE TO RELATED APPLICATION

This application is a continuation in part of U.S. patent application Ser. No. 16/146,103 filed Sep. 28, 2018 in which claims priority to U.S. Provisional Application Ser. No. 62/581,993 filed Nov. 6, 2017, both of which are hereby incorporated by reference in their entirety.

BACKGROUND

The disclosed technology is directed towards a cosmetic compact with paper or polyurethane labeling.

Cosmetic compacts are used to store cosmetic materials such as eyeshadow, blush, concealer, etc. These compacts can have two parts: a body and a cover affixed to the body via a plastic hinge. In many cases, the body and the cover are formed from plastics using conventional injection molding techniques. During this process, the body and cover are molded to include protrusions for forming a first hinge portion and a second hinge portion, respectively. These hinge portions are married to one another to form a final compact product. These hinges, however, are prone to breaking as these plastic hinges break when under relatively little stress. When stored in a women's purse, the damage to the items inside the purse when the hinge breaks is often disastrous.

Also, during conventional manufacturing processes, the pieces of the compact are molded and then assembled. If a customer wants to add labeling to the compact, the labeling is performed as an additional step, after assembly, which increases the cost of the final compact product considerably.

SUMMARY

The disclosed technology is directed towards a cosmetic compact that includes a spine with extensions. The spine allows the cosmetic compact to have an unlocked position and a locked position. In the unlocked position, pans that hold cosmetic products can be slid in to and out of an opening of the cosmetic compact. In the locked position, the extensions can be fixedly secure to the cosmetic compact for securing the pans within the cosmetic compact without the need of any adhesive materials.

In one implementation, a cosmetic compact can comprise: a hinge, the hinge including a spine having at least two extensions and at least two protrusions extending from the at least two extensions; a base, the base including at least two receivers and at least one opening configured to receive at least one pan; and a cover, wherein the cover and the base are connected to one another via the hinge, wherein, in a locked position, the extensions are configured to wrap around the base and the at least two protrusions are configured to be removably locked into the at least two receivers thereby securing the at least one pan within the at least one opening, and wherein, in an unlocked position, the at least two protrusions are configured to be removed from the at least two receivers thereby providing access to the at least one opening.

In some implementations, the cosmetic compact can further comprise: an outer wrap material, wherein the cover, the base and the spine are affixed to the outer wrap material. In some implementations, the outer wrap material can have a length greater than a length of the cover, the base and the spine. In some implementations, spacing can created between (1) the cover and the spine and (2) the base and the spine. In some implementations, the spacing can allow the hinge to movably connect the base to the cover.

In some implementations, the hinge can further include an outer spine wrap, wherein the outer spine wrap is adhered to the spine. In some implementations, the hinge can further include an inner spine wrap, wherein the inner spine wrap is adhered to the spine.

In some implementations, the cover and the base can include magnets for magnetically securing the cover to the base when the cosmetic compact is in a closed position. In some implementations, the base can include a platform and a bottom panel that are adhered to one another to form the base. In some implementations, the platform can include well openings. In some implementations, the bottom panel can include dividers, the dividers forming individual compartments for the at least one pan. In some implementations, the bottom panel can include ridges for raising the at least one pan.

In some implementations, the base can include a soft block for limiting movement of the at least one pan when loaded and locked into the base. In some implementations, the base can include a hard block for limiting movement of the at least one pan when loaded and locked into the base.

In some implementations, the cover can include a frame and a top panel that are adhered to one another to form the cover. In some implementations, the cover can further include a mirror. An advantage of the disclosed cosmetic compact is that the cosmetic compact can be assembled with outer wrap material being incorporated into the assembly process. The cosmetic compact also allows pans holding cosmetic material to be easily replaced or interchanged. Another advantage is a hinge that is more durable and can be designed to control an opening angle of an open compact.

BRIEF DESCRIPTION OF THE DRAWINGS

FIG. 6 is a top view of a platform of the cosmetic compact as shown in FIG. 1;

FIG. 7 is a cross-sectional side view of the platform of the cosmetic compact as shown in FIG. 1;

FIG. 8 is a bottom view of a platform of the cosmetic compact as shown in FIG. 1;

FIG. 9 is a top view of a well of the cosmetic compact as shown in FIG. 1;

FIG. 10 is a zoomed-in view of an injection gate as shown in FIG. 6.

FIG. 11 is a cross-sectional side view of a well of the cosmetic compact as shown in FIG. 6;

FIG. 68 is a back view of the spine of the cosmetic compact as shown in FIGS. 44*a* and 44*b;*

FIG. 69 is a front view of the spine of the cosmetic compact as shown in FIGS. 44*a* and 44*b;*

FIG. 70 is a side view of the spine of the cosmetic compact as shown in FIGS. 44*a* and 44*b;*

FIG. 71 is a top view of the spine of the cosmetic compact as shown in FIGS. 44*a* and 44*b;*

FIG. 72 is a perspective view of the spine of the cosmetic compact as shown in FIGS. 44*a* and 44*b;*

FIG. 73 is a perspective of the spine in a folded position of the cosmetic compact as shown in FIGS. 44*a* and 44*b;*

FIG. 74 is a front view of the spine in a folded position of the cosmetic compact as shown in FIGS. 44*a* and 44*b;*

FIG. 75 is a side view of the spine in a folded position of the cosmetic compact as shown in FIGS. 44*a* and 44*b;*

FIG. 76 is a front view of the block of the cosmetic compact as shown in FIGS. 44*a* and 44*b;*

FIG. 77 is a side view of the block of the cosmetic compact as shown in FIGS. 44*a* and 44*b;*

FIG. 78 is a top view of the foam of the cosmetic compact as shown in FIGS. 44*a* and 44*b;*

FIG. 79 is a side view of the foam of the cosmetic compact as shown in FIGS. 44*a* and 44*b;*

DETAILED DESCRIPTION OF THE INVENTION

Figure 1:
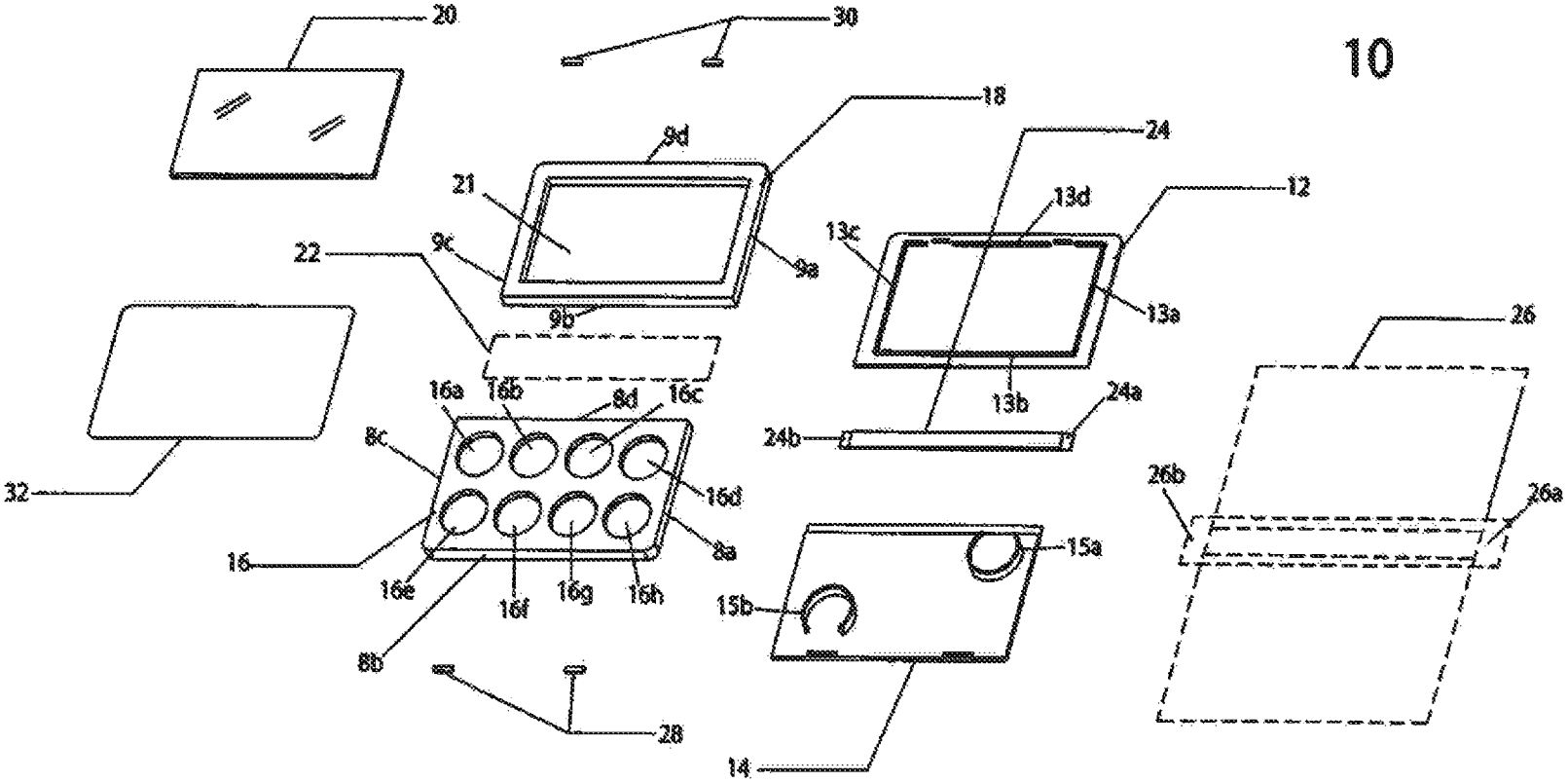
FIG. 1 is an exploded view of a cosmetic compact of the disclosed technology.

The disclosed technology relates to a cosmetic compact with labeling incorporated into the cosmetic compact during assembly. This can be achieved by having a cosmetic compact 10 that includes a top panel 12, a bottom panel 14, a platform 16, a mirror frame 18, mirror 20, spine wrap 22, a spine 24, outer wrap material 26 and magnets 28, 30, as shown in FIG. 1.

In some implementations, the top panel 12, the bottom panel 14, the platform 16, the mirror frame 18 and the spine 24 can be manufactured using injection molding. Injection molding is a manufacturing process for producing parts by injecting material into a mold. Injection molding can be performed with a host of materials, including metals, (for which the process is called die-casting), glasses, elastomers, confections, and most commonly thermoplastic and thermosetting polymers. After a product is designed, molds are made from metal, usually either steel or aluminum, and precision-machined to form the features of the desired part. Material for the part is (mixed then) fed into a heated barrel (hopper) and forced into a mold cavity through an injection gate, where it cools and hardens to the configuration of the cavity. Injection molding is widely used for manufacturing a variety of parts. Advances in 3D printing technology, using photopolymers which do not melt during the injection molding of some lower temperature thermoplastics, can be used for some simple injection molds. Parts to be injection molded must be very carefully designed to facilitate the molding process; the material used for the part, the desired shape and features of the part, the material of the mold, and the properties of the molding machine must all be considered. The versatility of injection molding is facilitated by this breadth of design considerations and possibilities.

As described above and shown in FIGS. 1 and 6-11, the platform 16 can be manufactured using molding methods known in the art using an injection material, e.g., plastic. The platform 16 can be molded to include one or more wells 16*a-h* for retaining cosmetic materials. The wells 16*a-h* can be circular but other shapes are contemplated. In some implementations, as shown in FIGS. 7 and 11, the wells 16*a-h* can have a calculated depth of any range, e.g. 0.05 mm-3 mm.

The sidewalls 8*a-c* of the platform 16 can be slightly longer than the depth of the wells 16*a-h*, as shown in FIGS. 1, 6 and 7 to accommodate the bottom panel 14 as will be described more fully below. In some implementations, sidewall 8*d* can be slightly shorter than sidewalls 8*a-c* to allow the bottom panel 14, spine wrap 22, spine 24 and outer wrap material 26 to be wrapped around and create a hinge 25 (FIGS. 2 and 3) of the cosmetic compact 10, as will be described more fully below.

Figure 5:
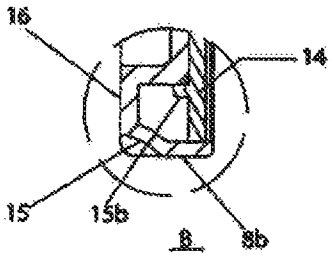
FIG. 5 is a close-up, cross-sectional view of the cosmetic compact as shown in Section B, FIG. 3.
Figure 15A:
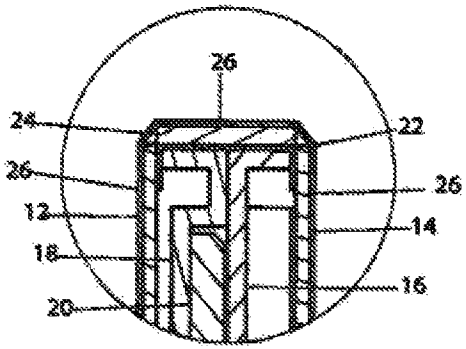
FIG. 15*a* is a close-up, cross-sectional side view of the cosmetic compact as shown in Section A, FIG. 14.
Figure 15B:
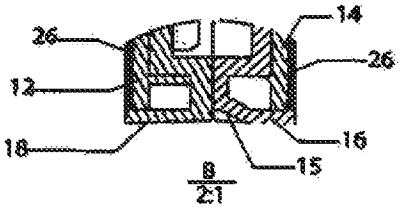
FIG. 15*b* is a close-up, cross-sectional side view of the cosmetic compact as shown in Section B, FIG. 14.
Figure 14:
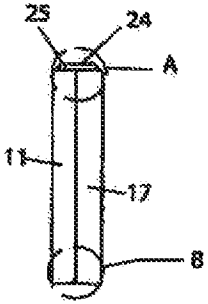
FIG. 14 is a side view of the cosmetic compact as shown in FIG. 2 in a closed position.
Figure 13:
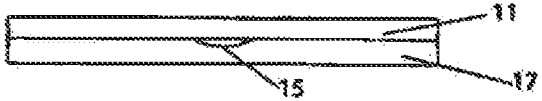
FIG. 13 is a front view of the cosmetic compact as shown in FIG. 2 in a closed position.

In some implementations, sidewall 8*b* of the platform 16 can include an indent 15 as shown in FIGS. 5 and 6. This indent 15 can be used for opening the cosmetic compact 10 when in a closed position (e.g., see FIGS. 13 and 15*b*). During the molding process, an injection gate can be located on a part to be molded, e.g., the platform 16 has an injection gate within well 16*f*, as shown in FIGS. 6 and 10. Gate locations, however, can vary depending on shape and size of the part to be molded.

The bottom panel 14 can be flat and have a rectangular shape but other shapes and sizes are contemplated. The bottom panel 14 can also include sealing seams 15*a-b*. The bottom panel 14 can be sized so that it fits within the sidewalls 8*a-c* of platform 16.

As shown in FIG. 1, the mirror frame 18 can include sidewalls 9*a-d*. The top panel 12 can be flat and have a rectangular shape but other shapes and sizes are contemplated. The top panel 12 can also include sealing seams 13*a-d*. The top panel 12 can be sized so that it fits within the sidewalls 9*a, c-d* of mirror frame 18. In some implementations, sidewall 9*b* can be slightly shorter than sidewalls 9*a, c-d* to allow the top panel 12, spine wrap 22, spine 24 and outer wrap material 26 to be wrapped around and create a hinge 25 of the cosmetic compact 10, as will be described more fully below.

The mirror frame 18 can be formed with an opening 21 for receiving a mirror 20. The mirror 20 can be placed within the opening 21 and in some cases adhered to the top panel 12 with an adhesive; however, other adhesive methods are contemplated. The mirror frame 18 can also have a well instead of an opening, and the mirror 20 can be adhered to the bottom of the well of the mirror frame 18.

Figure 3:
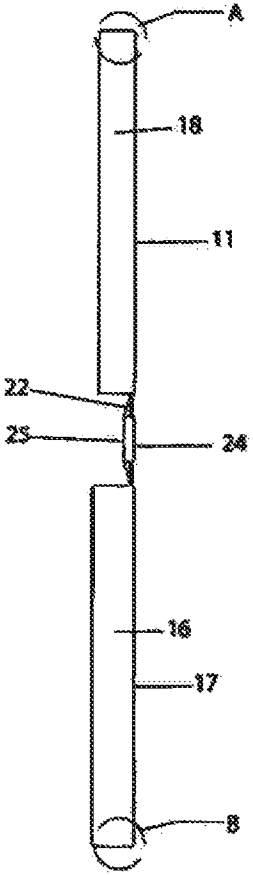
FIG. 3 is a side view of the cosmetic compact as shown in FIG. 1 in an opened position.

The spine 24 can be adhered to a spine wrap 22 with an adhesive. In some implementations, the spine 24 and the spine wrap 22 can be laminated together, and then adhered to the outer wrap material 26 thereby forming a hinge 25, as shown in FIGS. 2, 3, 14 and 15*a*. That is, the hinge 25 can be connected between the top panel 12 and bottom panel 14 with an adhesive so that the top panel 12 and the bottom panel 14 are bridged together by the hinge 25. This innovation allows the combination of injection parts with a spine wrap 22 to create the hinge 25 (FIGS. 2, 3, 14 and 15*a*). The hinge 25 allows the cosmetic compact 10 to open to, e.g., 180 degrees (FIG. 3). The spine wrap 22 can be a paper material but other materials, e.g., plastics, polyurethane (PU), fabrics, metals, foils are contemplated.

Figure 16:
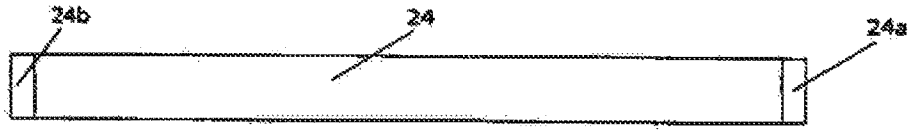
FIG. 16 is a top view of the spine as shown in FIG. 1.
Figure 17:
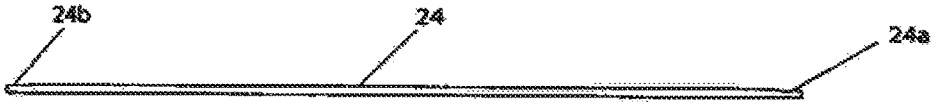
FIG. 17 is a side view of the spine as shown in FIG. 16.
Figure 18:
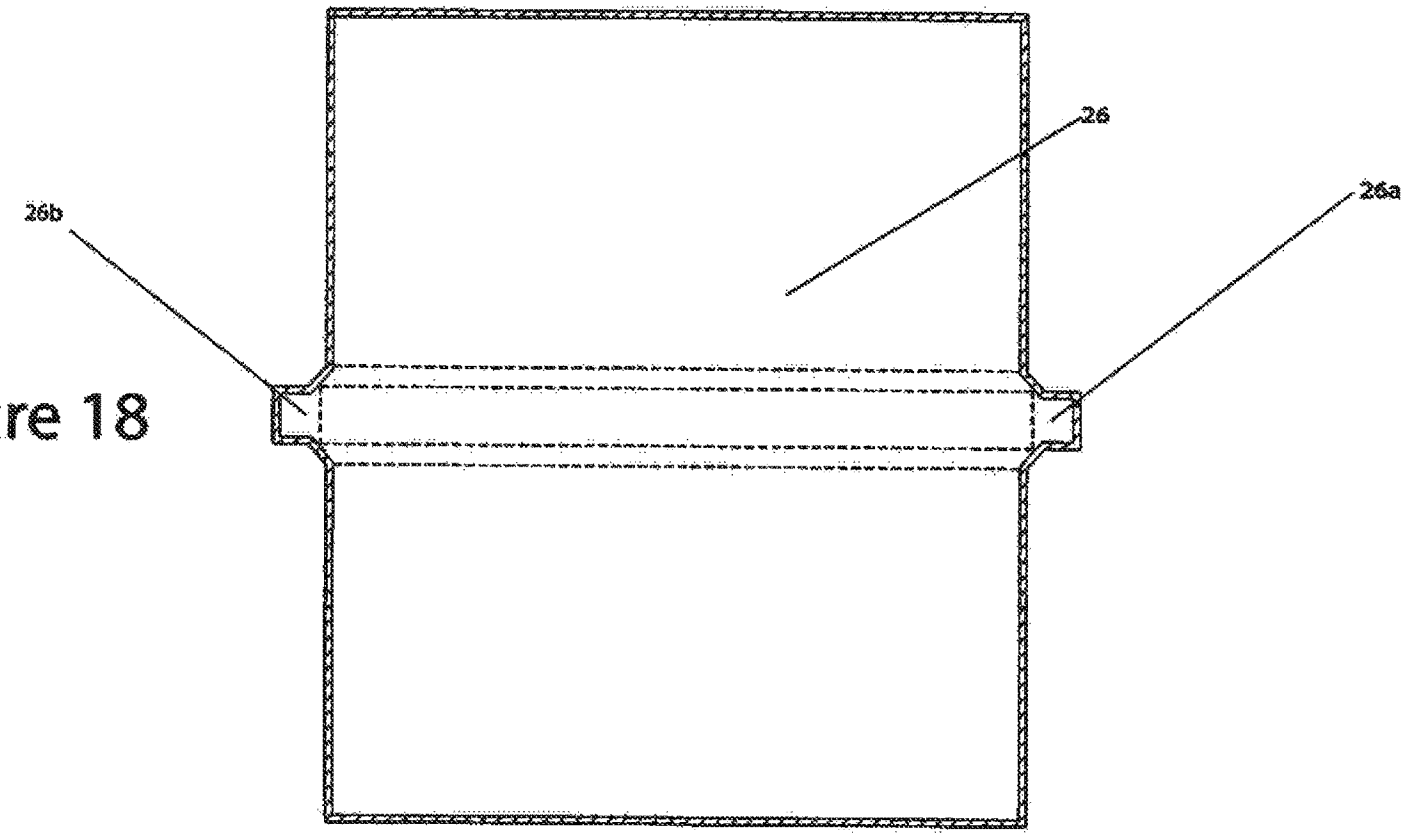
FIG. 18 is a top view of an outer wrap material used in conjunction with the spine shown in FIG. 16.

In some implementations, as shown in FIGS. 1, 16 and 17, the spine 24 can include indentations 24*a*, 24*b* near the sidewall. These indentations 24*a*, 24*b* allow the edges 26*a*, 26*b* (FIGS. 1, and 18) of the outer wrap material 26 to be folded inward and glued to the indentations so that the edges of the outer-wrap material can be hidden from view.

Figure 19:
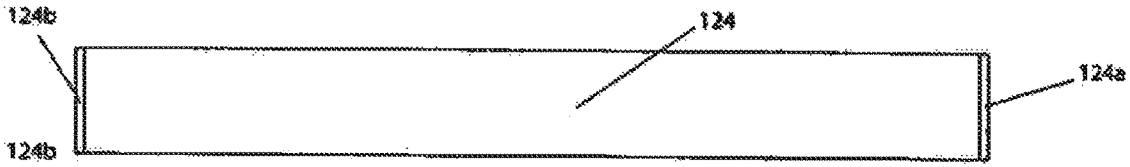
FIG. 19 is a top view of another version of a spine.
Figure 20:
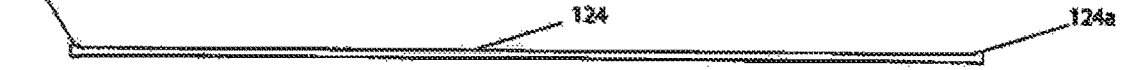
FIG. 20 is a side view of the spine as shown in FIG. 19.
Figure 21:
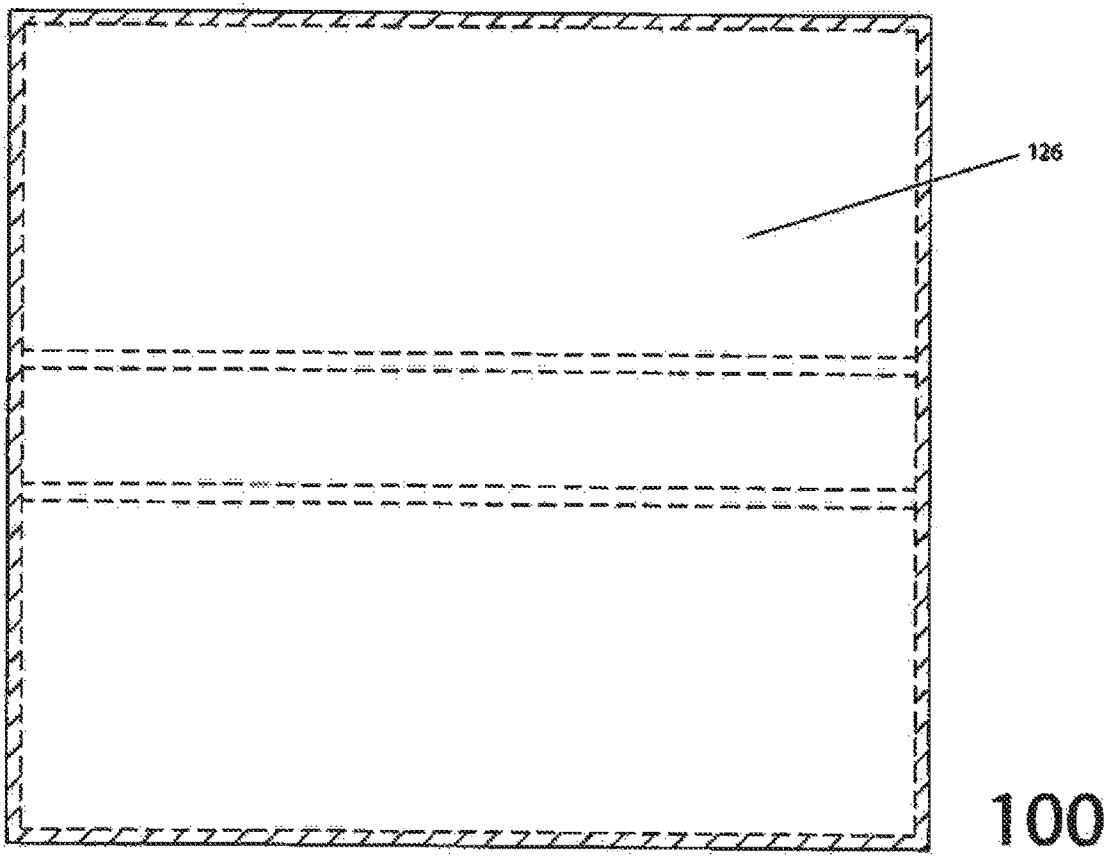
FIG. 21 is a top view of an outer wrap material used in conjunction with the spine shown in FIG. 19.

In other implementations, as shown in FIGS. 19-21, the spine 124 can include raised side walls 124*a-b*. In this implementation, the raised side walls 124 *a-b* hide the edges of the outer wrap 126 (FIG. 21).

The mirror frame 18 and the platform 16 can be fitted with magnets 28, 30. Magnets 30 can be secured to the mirror frame 18 within recesses located on the mirror frame 18 and magnets 28 can be secured to the platform 16 within recesses on a ledge of the platform 16. The magnets can be adhered with heat melt glue, but other securement methods are contemplated. These magnets 28, 30 are capable of magnetically securing the compact 10 in a closed position when not in use. It also allows the top cover 11 (FIGS. 2 and 3) and the cosmetic holder 17 (FIGS. 2 and 3) to provide a tight fit of contact for the cosmetic compact 10 when in a closed position so that cosmetic material does not escape the cosmetic compact 10 when not in use. In some implementations, a disc 32 (FIG. 1), e.g., a polyethylene terephthalate (PEG) disc, low density polyethylene (LDPE) disc, wax paper or other materials can be applied over the platform 16 to seal or protect cosmetic material stored within the platform 16. In some implementations, individual cosmetic trays (not shown) can be placed in openings of the wells 16*a-h*. The trays can be either removably secured or permanently secured within the wells 16*a-h* depending on application requirements.

Figure 12:
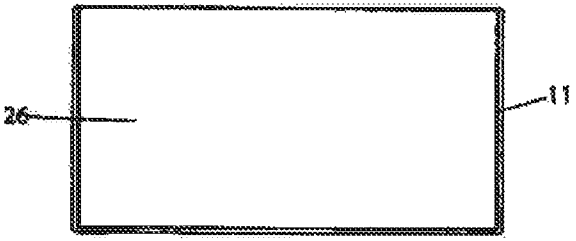
FIG. 12 a top view of the cosmetic compact as shown in FIG. 2 in a closed position.

Outer wrap material 26, e.g., paper, plastics, polyurethane (PU), fabrics, metals, or foils can be adhered to an outer surface of the top cover 11 (FIGS. 2-3 and 12), the cosmetic holder 17 and the hinge 25 (FIGS. 2-3 and 14), as a single piece. In other implementations, the outer wrap material 26 can be adhered in one or more pieces. The outer wrap material 26 can be decorated for marketing and advertising purposes.

In some implementations, the outer wrap material 26 can be pre-cut to size so that it has the same width as the top panel 12, bottom panel 14 and spine 24. The outer wrap can have a length to accommodate a combined length of the top panel 12, bottom panel 14 and spine 24. The outer wrap can also have a space between the spine and top panel and a space between the spine and bottom panel wherein the spaces allows room for the cosmetic compact 10 to open and close.

During assembly, the top panel 12, the spine 24 and the bottom panel 14 can be glued to the outer wrap material 26 with an adhesive and the edges of the outer wrap 26*a* and 26*b* can be folded over to the indentations of the Spine 24*a* and 24*b* and glued with an adhesive. Step 1. Magnets 28 and magnets 30 can be glued to the platform 16 and mirror frame 18, respectively. Step 2.

The spine wrap 22 can be glued over the spine 24. Step 3. (In some implementations, the spine wrap 22 and spine 24 can be adhered to each other in a separate step and the combination can be glued to the outer wrap material 26 as a single piece.)

Figure 2:
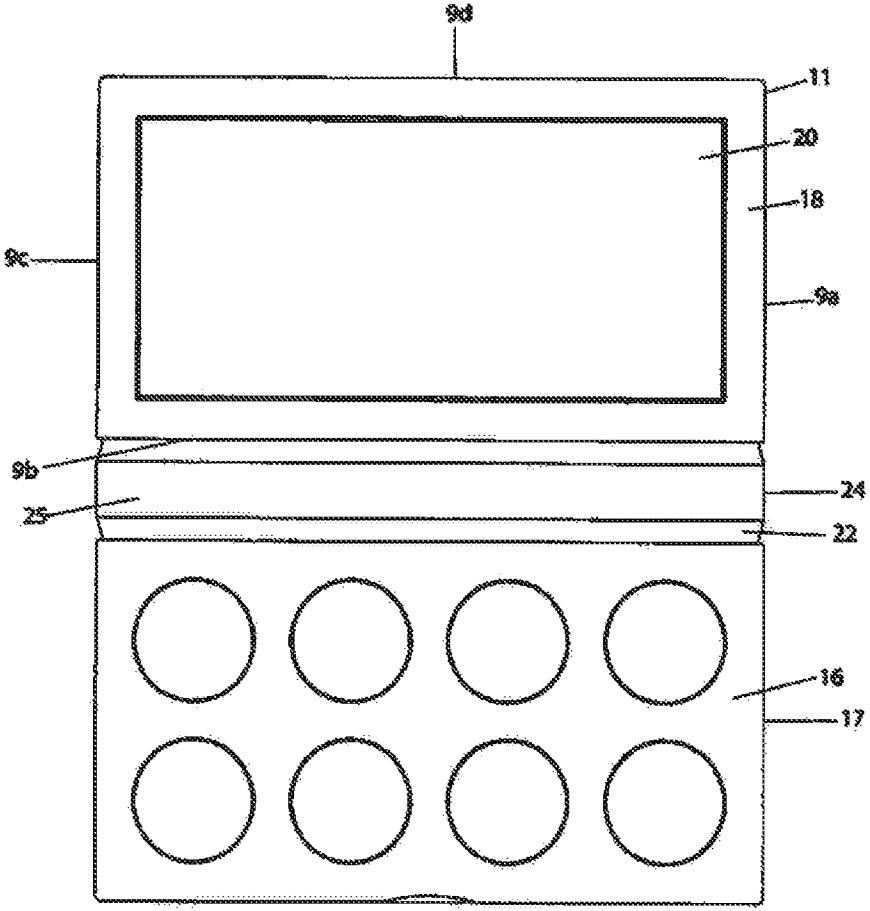
FIG. 2 is a top view of the cosmetic compact as shown in FIG. 1 in an opened position.

The platform 16 can be adhered to the bottom panel 14. Step 4. More specifically, as show in FIG. 5, the bottom panel 14 can be placed within the sidewalls a-c of the platform 16 so that the sidewalls 8*a-c* hide the edges of the bottom panel 14 and the edges of the outer wrap material 26. This placement allows the sealing seams 15*a-b* to be adjacent and touching the walls of well 16*d*, 16*e* (FIG. 1). A sonic weld can then be performed to weld sealing seam 15*a* to well 16*e* and sealing seam 15*b* to wells 16*d*. Other adhesive mechanisms are contemplated, e.g., adhesives. This step (Step 4) forms the cosmetic holder 17 (FIGS. 2 and 3).

Figure 4:
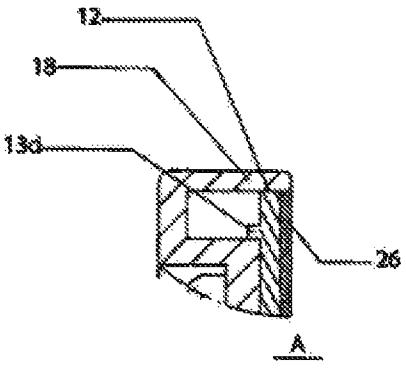
FIG. 4 is a close-up, cross-sectional view of the cosmetic compact as shown in Section A, FIG. 3.

The mirror frame 18 can be adhered to the top panel 12. Step 5. More specifically, as show in FIG. 4, the top panel 12 can be placed within the sidewalls 9*a, c-d* of mirror frame 18 so that the sidewalls 9*a, c-d*, hide the edges of the top panel 12 and the edges of the outer wrap material 26. This placement allows sealing seams 13*a-d* to be adjacent and touching the sidewalls 9*a-d* of mirror frame 18 so that a sonic weld can be performed to weld sealing seams 13-*d* to the sidewalls 9*a-d* of mirror frame 18. This step (Step 5) forms a top cover 11 (FIGS. 2 and 3). Please note, steps 3-5 can be done one at time or simultaneously.

The mirror 20 can be glued within the mirror frame (Step 6) and a dust cover 32 can be placed over the platform 16 (Step 7). Once these steps (Steps 1-7) are completed, the cosmetic compact can be folded closed and packaged for shipping. Please note, that the order of these steps are for illustrative purposes as these steps can be performed in several different orders and combinations.

As shown in FIG. 22-27, the cosmetic compact 200 can include a top panel 212, a bottom panel 214, a platform 216, a mirror frame 218, mirror 220, spine wrap 222, a spine 224, outer wrap material 226 and magnets 228, 230.

In some implementations, the top panel 212, the bottom panel 214, the platform 216, the mirror frame 218 and the spine 224 can be manufactured using injection molding, as described above.

Figure 37A:
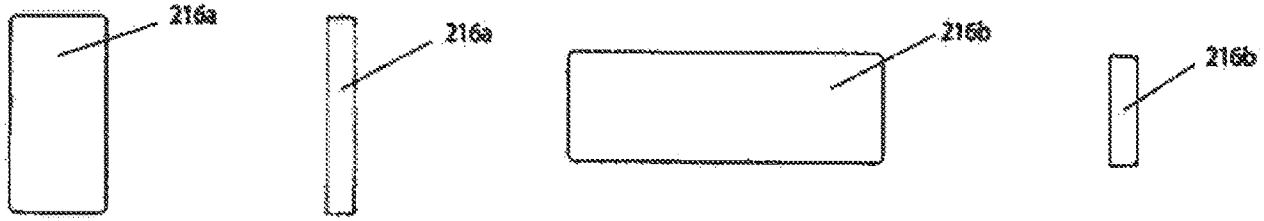
FIG. 37*a* are views of a well of the cosmetic compact as shown in FIG. 22.
Figure 37B:
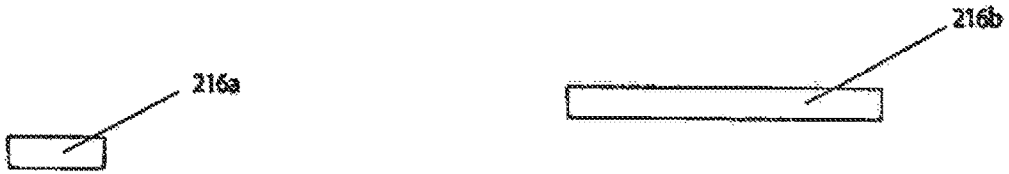
FIG. 37*b* are views of a well of the cosmetic compact as shown in FIG. 22.
Figure 38:
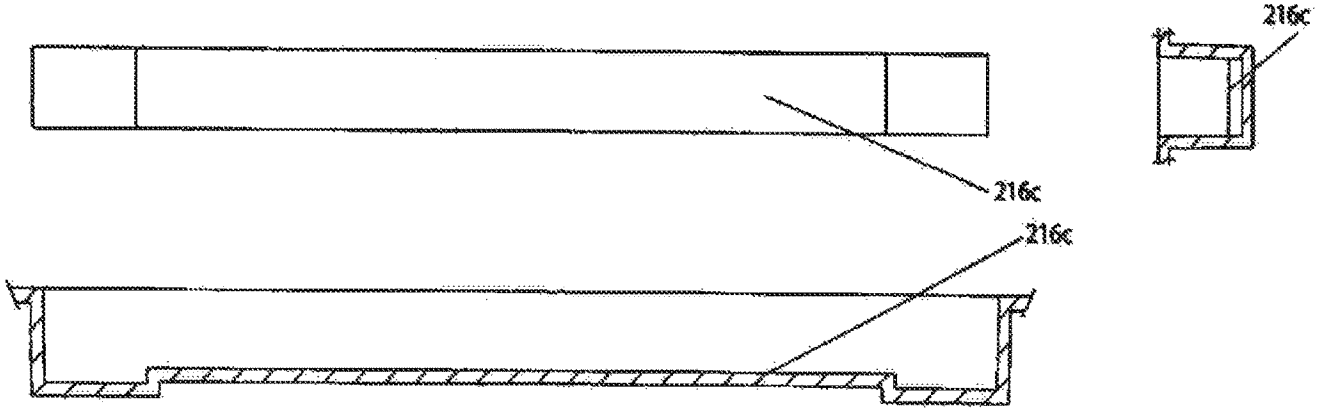
FIG. 38 are views of a well of the cosmetic compact as shown in FIG. 22.
Figure 40:
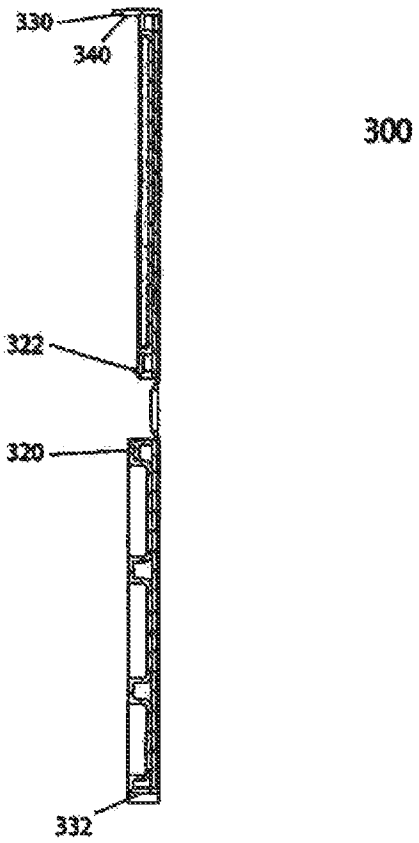
FIG. 40 is a cross-sectional, side view of a cosmetic compact of the disclosed technology.
Figure 39:
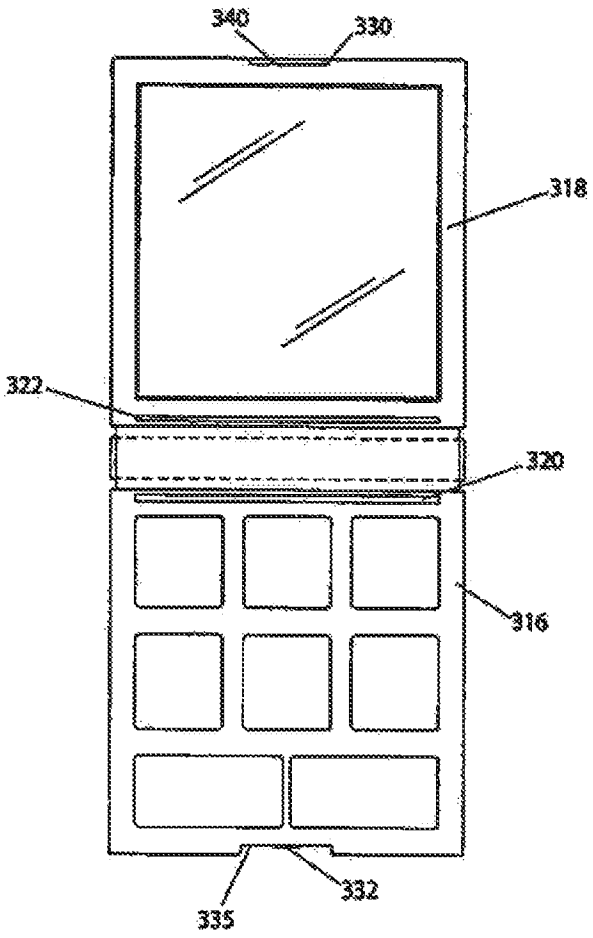
FIG. 39 is an open view of a cosmetic compact of the disclosed technology.
Figure 42:
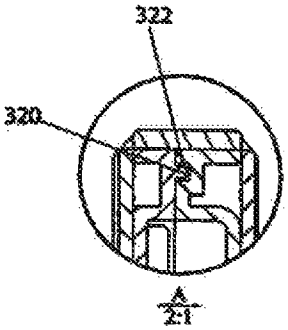
FIG. 42 is a close-up of a cross-sectional, closed side view of a cosmetic compact of the disclosed technology as shown in Section A, FIG. 41.
Figure 43:
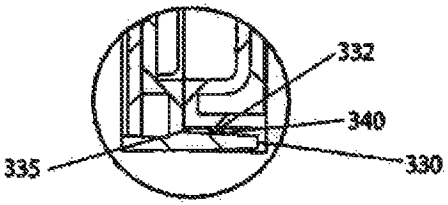
FIG. 43 is a close-up of a cross-sectional, closed side view of a cosmetic compact of the disclosed technology as shown in Section B, FIG. 41.
Figure 41:
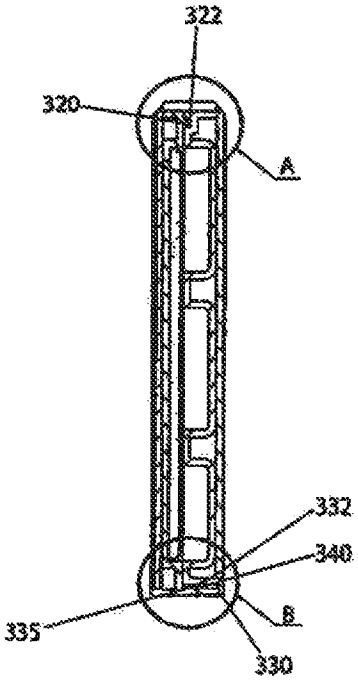
FIG. 41 is a cross-sectional, side view of the closed view of a cosmetic compact of the disclosed technology.

As shown in FIGS. 22 and 34-36, the platform 216 can be manufactured using molding methods known in in the art using an injection material, e.g., plastic. The platform 216 can be molded to include one or more wells 216*a-c* for retaining cosmetic materials and cosmetic tools, e.g., cosmetic trays and applicators. The wells 216*a-c* can be rectangular but other shapes are contemplated. In some implementations, as shown in FIGS. 37*a*, 37*b* and 38, the wells 216*a-b* and *c* can have a calculated depth of any range, e.g., 0.05-3 mm.

The sidewalls 208*a-d* of the platform 216 can be slightly longer than the depth of the wells 216*a-c* so as to accommodate the bottom panel 214 as will be described more fully below. In some implementations, sidewall 208*d* (FIG. 22) can be slightly shorter than sidewalls 208 *a, b* and *c* so as to allow the outer wrap material 226 to be wrapped around a hinge 225 (FIG. 25) of the cosmetic compact 200.

Figure 22:
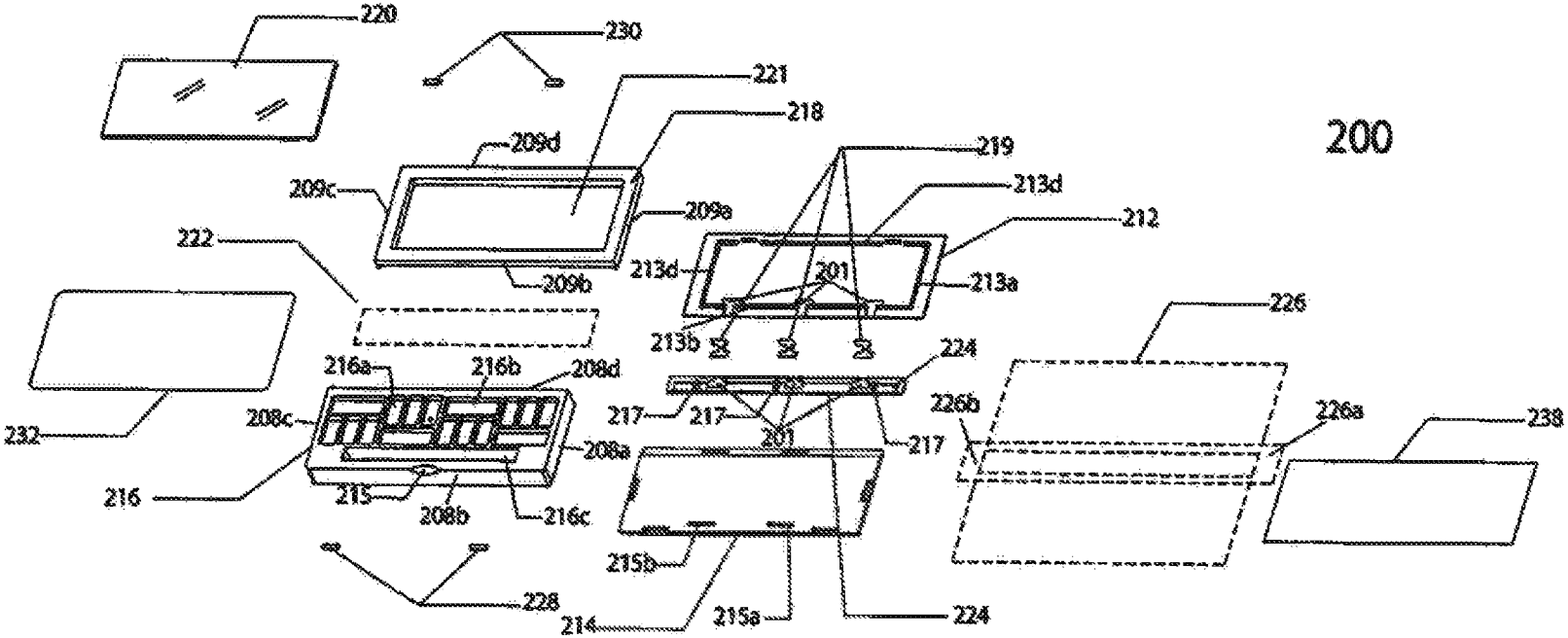
FIG. 22 is an exploded view of a cosmetic compact of the disclosed technology.
Figure 28:
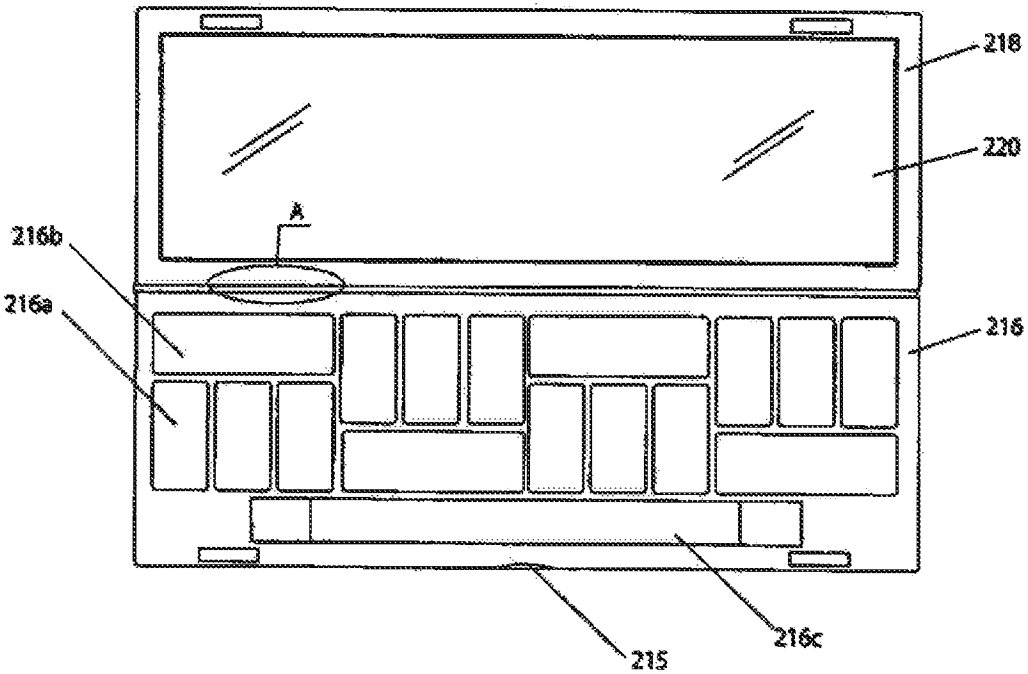
FIG. 28 is a top view of the cosmetic compact as shown in FIG. 22 in an opened position.
Figure 31:
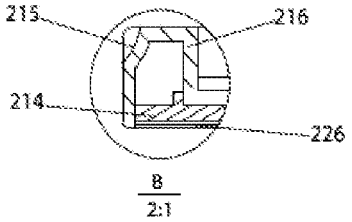
FIG. 31 is a close-up, cross-sectional view of the cosmetic compact as shown in Section B, FIG. 30.

One of the sidewalls 208*b* of the platform 216 can also include an indent 215 as shown in in FIGS. 22, 28 and 31. This indent 215 can be used for opening the cosmetic compact 200 when in a closed position.

The bottom panel 214 can be flat having a rectangular shape but other shapes are contemplated. The bottom panel 214 can also include sealing seams 215*a* and 215*b*. The bottom panel 214 can be sized so that it fits within the sidewalls 208 *a-c* of platform 216.

As shown in FIG. 22, the mirror frame 218 can include sidewalls 209*a-d*. The top panel 212 can be flat and have a rectangular shape but other shapes are contemplated. The top panel 212 can also include sealing seams 213*a-d*. The bottom panel 214 can be sized so that it fits within the sidewalls 209*a-d* of mirror frame 218.

The mirror frame 218 can be formed with an opening 221 for receiving a mirror 220. The mirror 220 can be placed within the opening 221 and adhered to the top panel 212 with an adhesive; however, other adhesive methods are contemplated. The mirror frame 218 can also have a well instead of an opening, and the mirror 220 can be adhered to the bottom of the well in the mirror frame 218.

Figure 25:
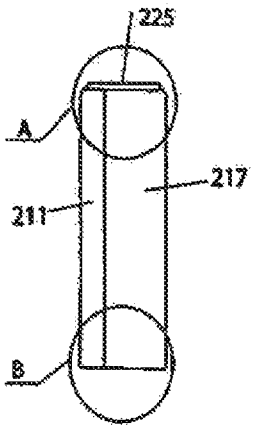
FIG. 25 is a side view of the closed cosmetic compact as shown in FIG. 22 in a closed position.
Figure 23:
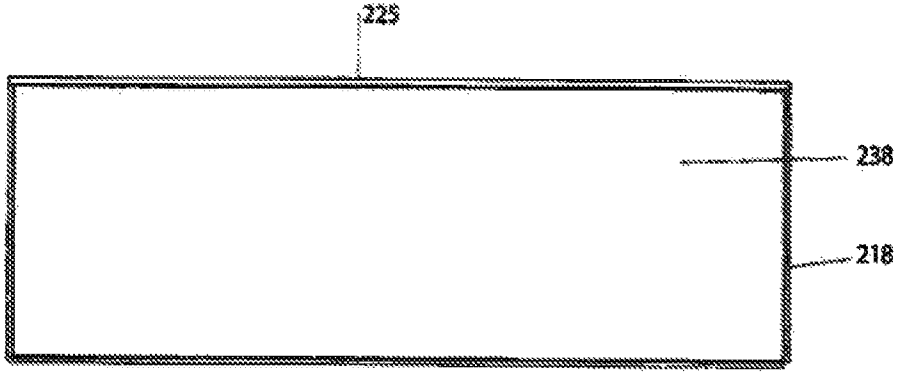
FIG. 23 a top view of the cosmetic compact as shown in FIG. 22 in a closed position.
Figure 29:
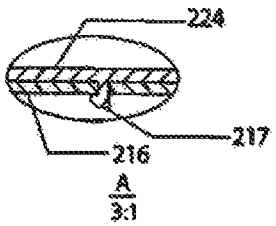
FIG. 29 is a close-up, cross-sectional view of the cosmetic compact as shown in Section A, FIG. 28.
Figure 30:
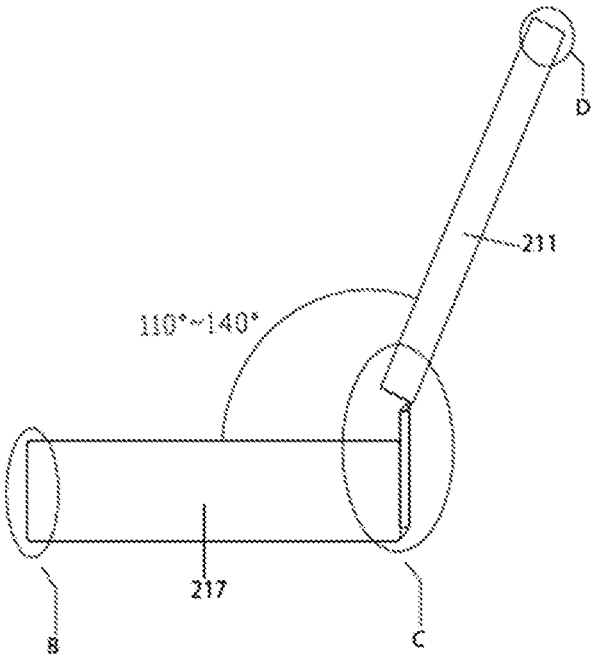
FIG. 30 is a side view of the cosmetic compact as shown in FIG. 22 in an opened position.
Figure 32:
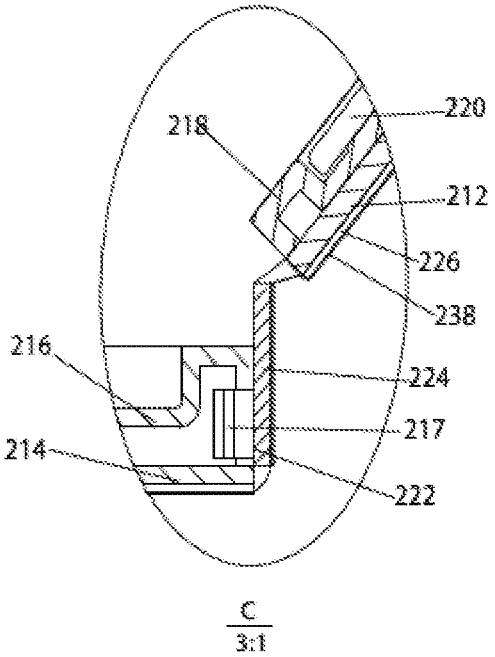
FIG. 32 is a close-up, cross-sectional view of the cosmetic compact as shown in Section C, FIG. 30.
Figure 33:
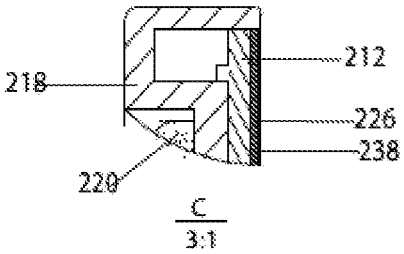
FIG. 33 is a close-up, cross-sectional view of the cosmetic compact as shown in Section D, FIG. 30.
Figure 34:
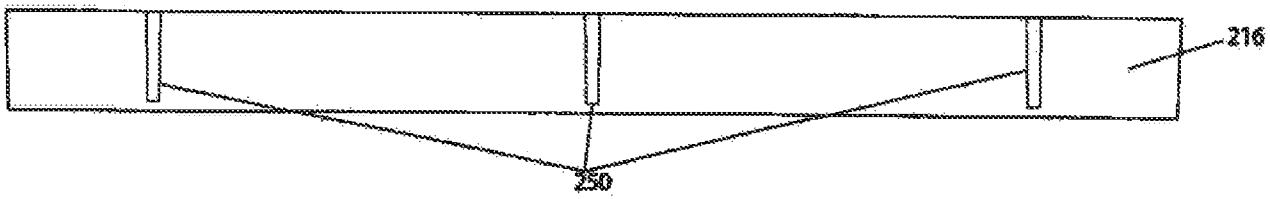
FIG. 34 is a back view of a platform of the cosmetic compact as shown in FIG. 22.
Figure 35:
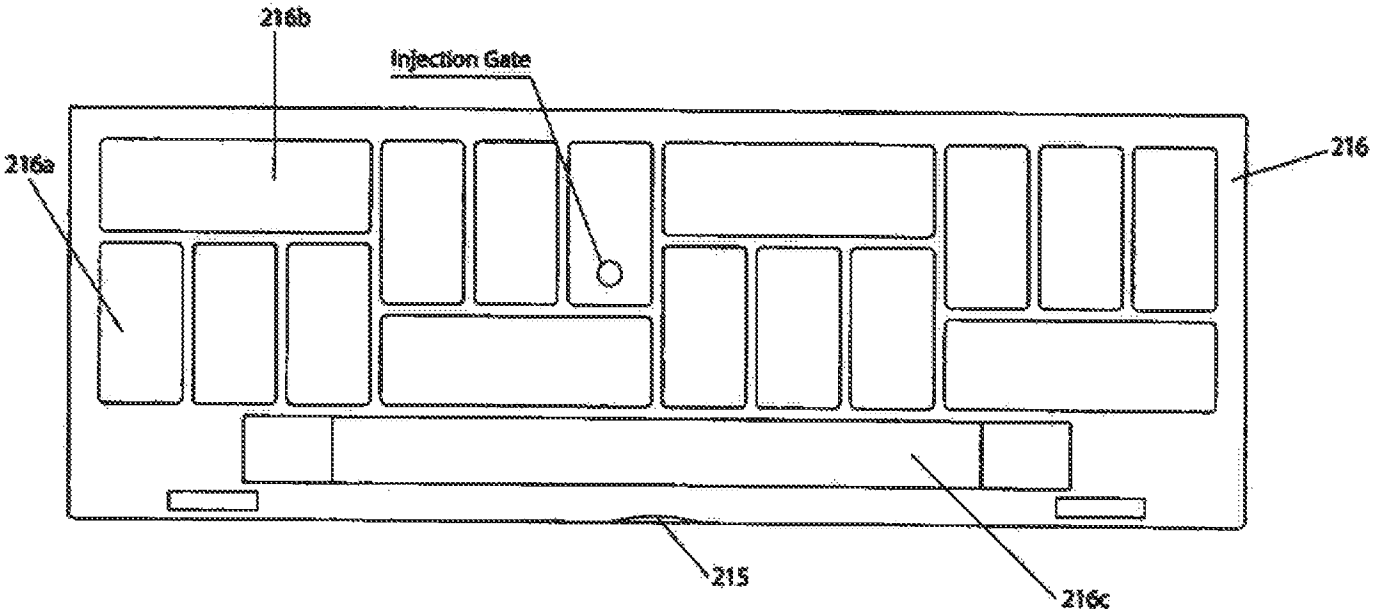
FIG. 35 is a top view is of a platform of the cosmetic compact as shown in FIG. 22.
Figure 36:
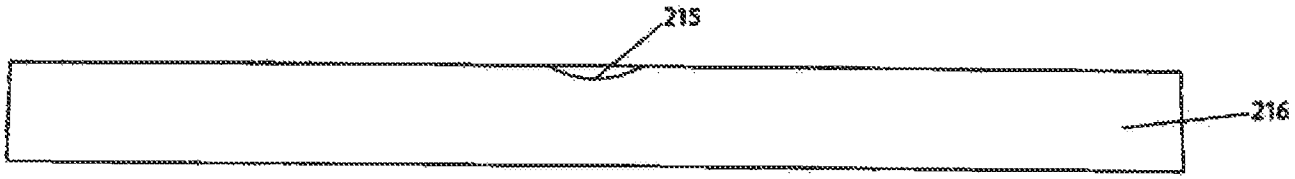
FIG. 36 is a front view is a top view of a platform of the cosmetic compact as shown in FIG. 22.

The spine 224 can be adhered to a spine wrap 222 with an adhesive and form part of a hinge 225 (FIGS. 23 and 25). In some implementations, the spine 224 can be connected to the platform 216 through a mechanical fit as show in FIGS. 30 and 32. That is, the spine 224 can include posts 217 (FIG. 22) that enter cavities 250 (FIG. 34) on a sidewall of the platform 216. Once the posts 217 are secured within the cavities 250 (FIG. 29) with a snap fit they are unable to be removed.

The hinge 225 can also include angle control tabs 219 used to restrict the compact from fully opening. The angle control tabs 219 allow the cosmetic compact to open at a specific opening range as predetermined, e.g. 100 to 140 degrees. The angle control tabs 219 can be secured with placement openings 201 on the spine 224 and the top panel 212 (FIG. 22). This innovation allows the combination of injection parts with a material to create the hinge 225.

The mirror frame 218 and the platform 216 can also be fitted with magnets 228, 230. Magnets 230 can be secured within recesses on frame 218 and magnet 228 can be secured within recesses on a ledge of the platform 216. The magnets can be adhered with heat melt glue, but other securement methods are contemplated. These magnets 228, 230 are capable of magnetically securing the compact 200 in a closed position when not in use while the top cover 211 (FIGS. 24 and 25) and the cosmetic holder 217 (FIGS. 24 and 25) can provide a tight fit of contact for the cosmetic compact 200 when in a closed position so that cosmetic material does not escape the cosmetic compact 200 when not in use. PEG Disc 232, LDPE, wax paper and other materials can be contemplated and applied over the platform 216 to seal the cosmetic material in place. In some implementations, individual cosmetic trays or applicators can be placed in the wells 216*a-c* that can be either removable secured or permanently secured within the wells 216*a-c* depending on application requirements.

An outer wrap material 226 e.g. paper, plastics, polyurethane, fabrics, metals, or foils can be adhered to an outer surface of the top cover 211, the cosmetic holder 217 and the hinge 225 as a single piece after assembly. In other implementations, the outer wrap material 226 can be adhered in one or more pieces. The outer wrap material 226 can also be decorated with lenticular prints 238 for marketing and advertising purposes.

In some implementations, the outer wrap material 226 can be pre-cut to size so that it has the same width as the top panel 212, bottom panel 214 and spine 224. The outer wrap can have a length to accommodate a combined length of the top panel 212, bottom panel 214 and spine 224. The outer wrap can also have a space between the spine and top panel and a space between the spine and bottom panel wherein the spaces allows room for the cosmetic compact 22 to open and close.

During assembly, the top panel 212, the spine 224 and the bottom panel 214 can be glued to the outer wrap material 226 with an adhesive and the edges of the outer wrap 226*a* and 226*b* can be folded over to the indentations of the spine 224 glued with an adhesive. Step 1. Magnets 228 and magnets 230 can be glued with the recesses of the platform 216 and mirror frame 218, respectively. Step 2.

Angle control tabs can be glued within recesses 201 on the top panel 212 and the spine 224. Step 3. The spine wrap can be adhered over the spine 224. Step 4. The posts 217 of the spine 224 are snap fitted with recesses 250 of the platform 216. Step 5.

Figure 24:
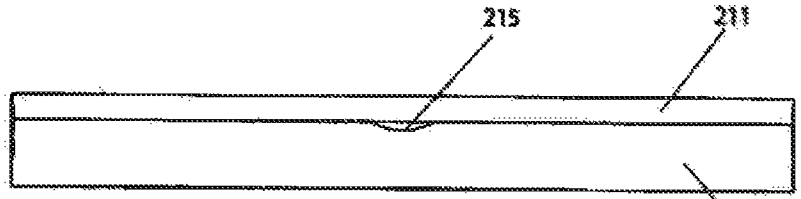
FIG. 24 is a front view of the cosmetic compact as shown in FIG. 22 in a closed position.
Figure 27:
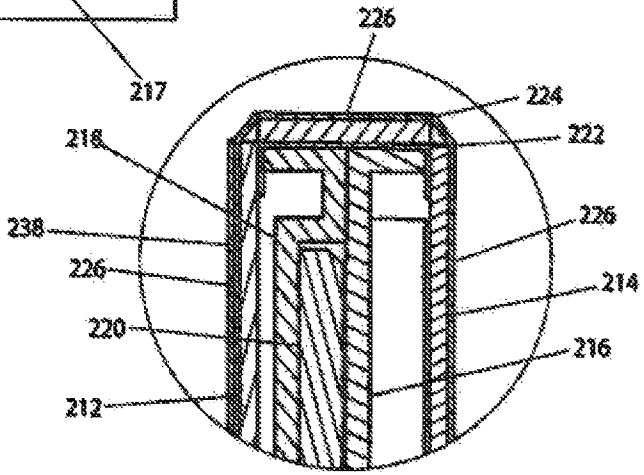
FIG. 27 is a close-up, cross-sectional view of the cosmetic compact as shown in Section A, FIG. 22.
Figure 26:
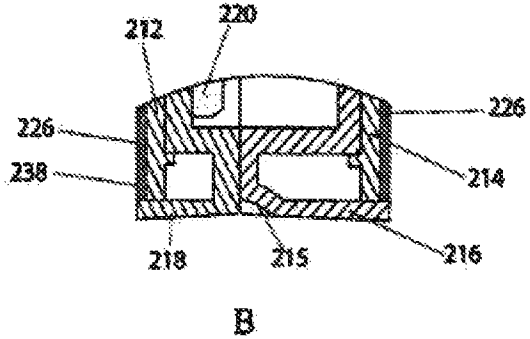
FIG. 26 is a close-up, cross-sectional view of the closed cosmetic compact as shown in Section B, FIG. 22.

The platform 216 is then fitted to and adhered to the bottom panel 214. Step 6. More specifically, the bottom panel 214 can be placed within the sidewalls 208*a-d* of the platform 216 so that the sidewalls 208*a-c* hide the edges of the outer wrap material 226. This placement allows the sealing seams 215*a-b* to be adjacent and touching the walls of well 216*c*. A sonic weld can then be performed to weld sealing seam 215*a* and 215*b* to well 216*c*. Other adhesive mechanisms are contemplated, e.g., adhesives. This step (Step 6) forms the cosmetic holder 217 (FIGS. 24 and 25).

The mirror frame 218 can be adhered to the top panel 212. Step 5. More specifically, the top panel 212 can be placed within the sidewalls 209*a-d* of mirror frame 218 so that the sidewalls 209*a, c-d*, hide the edges of the outer wrap material 226. This placement allows sealing seams 213*a-d* of are adjacent and touching the sidewalls 209*a-d* of mirror frame 218 so that a sonic weld can be performed to weld sealing seams 213-*d* to the sidewalls 209*a-d* of mirror frame 218. This step (Step 7) forms a top cover 211 (FIGS. 24 and 25). Please note, steps 3-5 can be done one at time or simultaneously.

The mirror 220 can then be glued within the mirror frame 218 (Step 8), a dust cover can be placed over the platform (Step 9) and a lenticular print 238 can be adhered to the top of the compact 200. Once these steps (Steps 1-7) are completed, the cosmetic compact can be folded closed and packaged for shipping. Please note, that the order of these steps are for illustrative purposes as these steps can be performed in a number of different combinations.

In another implementation, shown in FIGS. 39-43, the cosmetic compact 300 can include a top cover 318 having extruding tabs 322, 330, 340 and a platform 316 having recesses 320, 335 as well as an extruding tab 332. In a closed position, the tabs 322, 330, and 340 can be friction fitted into the recesses 320, 332 and past extruding tab 335. This allows the compact 300 to close with friction when the cover 318 and the platform 316 are pushed together to close the compact 300. That is, the extruding tabs 322, 330, 340, 335 and recesses 320, 330 allow the compact 300 to stay in a closed position when not in use so that cosmetic material does not escape the cosmetic compact 300 when not in use. The extruding tab 330 can also have an external thumb notch (not shown) for the costumer to apply force, and while holding the base make an upward motion and open the compact.

In another implementation, as shown in FIGS. 44*a*-84, a cosmetic compact 400 is shown that includes a spine 407 with extensions 408*a-b* which allows the cosmetic compact 400 to have an unlocked position and a locked position. In the unlocked position, pans 450*a-e* that hold cosmetic products can be slid in to and out of an opening of the cosmetic compact 400. In the locked position, the extensions 408*a-b* can be fixedly secure to the cosmetic compact 400 for securing the pans 450*a-e* within the cosmetic compact 400 without the need of any adhesive materials.

Figure 44A:
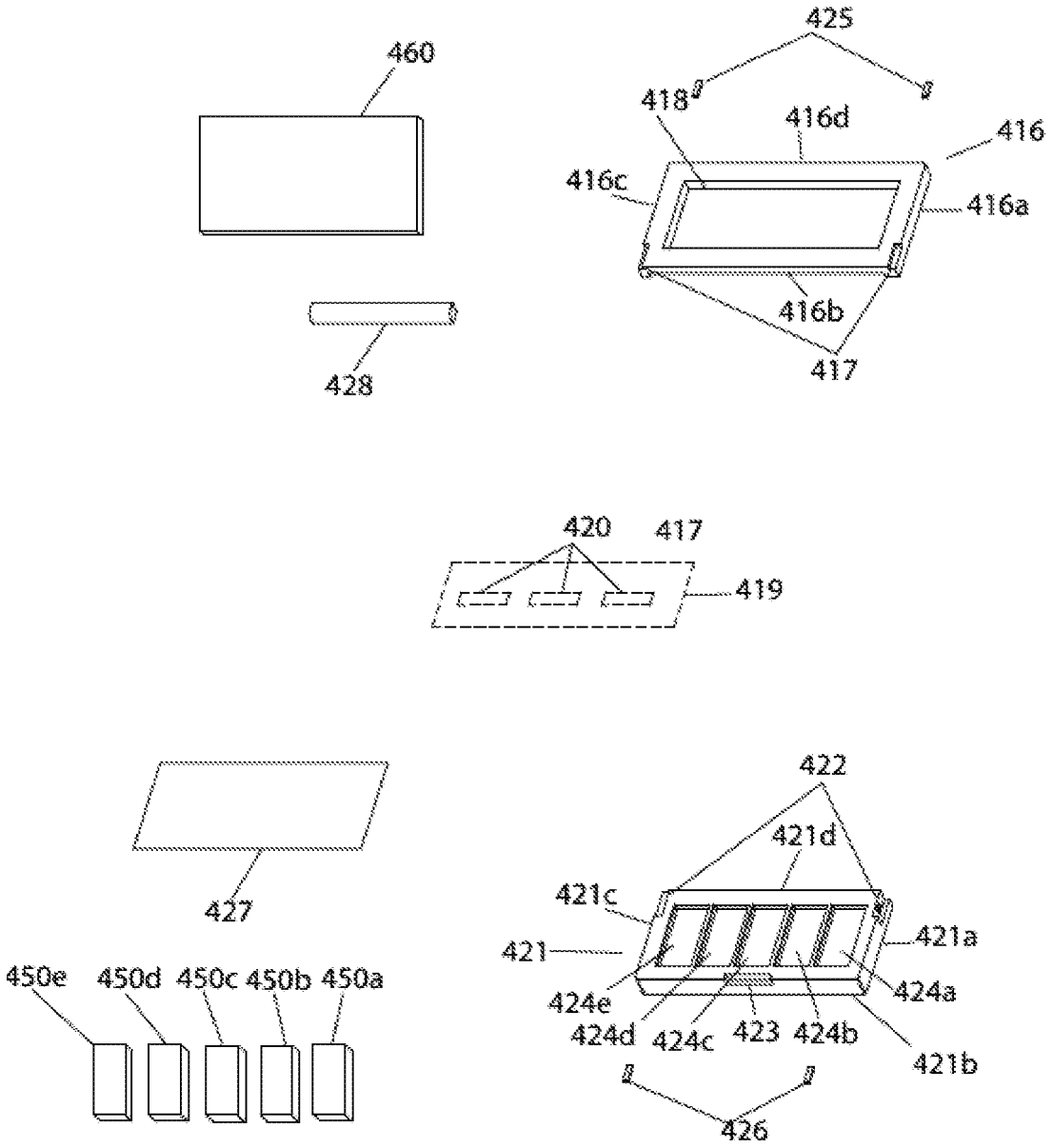
FIGS. 44*a* and 44*b* are exploded views of a cosmetic compact of the disclosed technology.
Figure 44B:
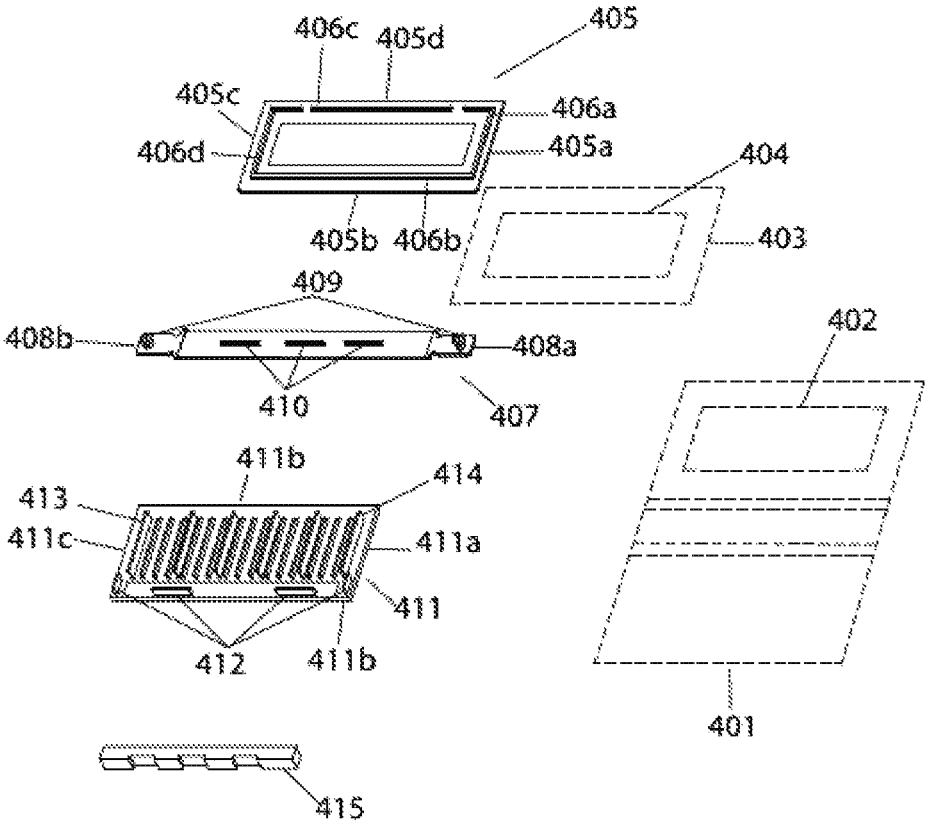

The cosmetic compact 400 can include a top panel 405, a bottom panel 411, a platform 421, a spine 407, a mirror frame 416, a mirror 460, an inner spine wrap 419, an outer spine wrap 403, an outer wrap material 401, magnets 425, 426, pans 450*a-e*, a soft block 415, a hard block 428 and protective paper 427, as shown in FIGS. 44*a* and 44*b* and described more fully below.

In some implementations, the top panel 405, the bottom panel 411, the platform 421, the mirror frame 416, the spine 407, and the hard block 428 can be manufactured using injection molding. Injection molding is a manufacturing process for producing parts by injecting material into a mold. Injection molding can be performed with a host of materials, including metals, (for which the process is called die-casting), glasses, elastomers, confections, and most commonly thermoplastic and thermosetting polymers. After a product is designed, molds are made from metal, usually either steel or aluminum, and precision-machined to form the features of the desired part. Material for the part is (mixed then) fed into a heated barrel (hopper) and forced into a mold cavity through an injection gate, where it cools and hardens to the configuration of the cavity. Injection molding is widely used for manufacturing a variety of parts. Advances in 3D printing technology, using photopolymers which do not melt during the injection molding of some lower temperature thermoplastics, can be used for some simple injection molds. Parts to be injection molded must be very carefully designed to facilitate the molding process; the material used for the part, the desired shape and features of the part, the material of the mold, and the properties of the molding machine must all be considered. The versatility of injection molding is facilitated by this breadth of design considerations and possibilities.

The platform 421 can be adhered to the bottom panel 411 thereby forming a base 30 of the cosmetic compact 400. The mirror frame 416 can be adhered to the top panel 405 thereby forming a cover 429 of the cosmetic compact 400. The cover 429 and the base 430 can be connected to each with a hinge 436, as shown in FIGS. 45-55 and will be described more fully below.

Figure 56:
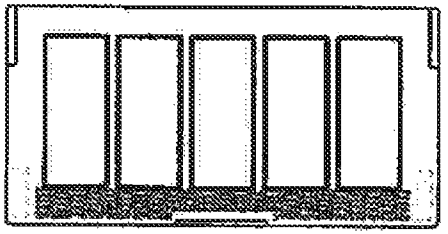
FIG. 56 is a top view of the platform of the cosmetic compact as shown in FIGS. 44*a* and 44*b;*
Figure 58:
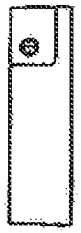
FIG. 58 is a side view of the platform of the cosmetic compact as shown in FIGS. 44*a* and 44*b;*
Figure 57:
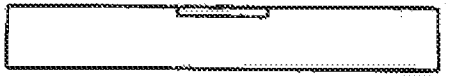
FIG. 57 is a front view of the platform of the cosmetic compact as shown in FIGS. 44*a* and 44*b;*

As shown in FIGS. 56-58, the platform 421 can be shaped as a rectangle but other shapes are contemplated. The platform 421 can includes four sides 421*a-d*, wells 424*a-e*, receivers 452*a-b* and indents 422*a-b*, 423.

Figure 59:
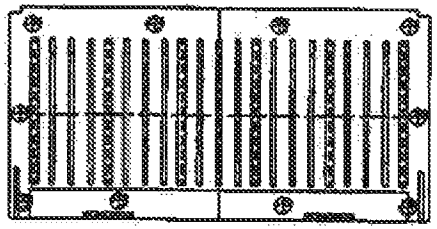
FIG. 59 is a top view of the bottom panel of the cosmetic compact as shown in FIGS. 44*a* and 44*b;*
Figure 61:
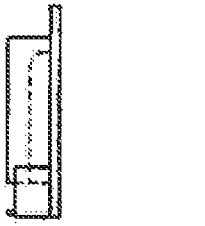
FIG. 61 is a side view of the bottom panel of the cosmetic compact as shown in FIGS. 44*a* and 44*b;*
Figure 60:
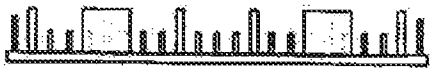
FIG. 60 is a front view of the bottom panel of the cosmetic compact as shown in FIGS. 44*a* and 44*b;*

As shown in FIGS. 59-61, the bottom panel 411 can have a complementary shape to that of the platform as the bottom panel 411 can be received by the platform to form the base 30 of the cosmetic compact 400. The bottom panel can further include edges 11*a-d*, sealing seams 12, dividers 14*a-f* and ridges 13. When the platform 421 and bottom panel 411 are adhered together to form the base 30, openings 454*a-e* can be created within the base 30. These openings 454*a-e* can be configured to receive the pans 450*a-e*. The pans 450*a-e* can be inserted through openings 454*a-e* into individual compartments formed by the dividers 14*a-f*.

The pans 450*a-e* can be manufactured using molding methods known in the art using an injection material, e.g., plastic. The pans 450*a-e* can be individually molded, and each pan can be configured to retain cosmetic materials. In some implementations, the pans can be formed in a single unit having one or more wells (not shown). The pans 450*a-e* can be rectangular but other shapes are contemplated. In some implementations, the pans can have a length, width and height that is capable of fitting within the openings 454*a-e* of the base 30. The bottom panel 411 also has ridges 413 to raise pans 450*a-e*, as shown in FIG. 60.

Additionally, in a rear portion of the openings 454*a-e*, a soft block 415 (FIGS. 44*a*, 44*b*, 49 and 78-79) can be placed to reduce movement of the pans 450*a-e* when the spine 407 is in a locked positioned. The soft block 415 can be made from, e.g., a foam material or any other soft pliable medium. A hard block 428, made from a hard material, e.g., plastic, can be place in a front portion of the openings 454*a-e* so when the extensions 408*a-b* are folded and locked the pans 450*a-e* can further be held in place.

In some implementations, sides 21*a*, 21*c* of the platform 421 can have indents 422*a-b* for partially receiving the extensions 408*a-b* of the spine 407 when in a locked position. In some implementations, sidewall 421*b* of the platform 421 can include an indent 423 as shown in FIGS. 44*a*, 44*b*, 45 and 52. This indent 423 can be used for opening the cosmetic compact when in a closed position (e.g., see FIG. 52).

Figure 62:
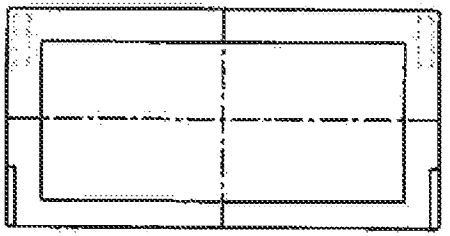
FIG. 62 is a top view of the mirror frame of the cosmetic compact as shown in FIGS. 44*a* and 44*b;*
Figure 64:
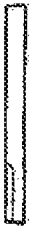
FIG. 64 is a side view of the mirror frame of the cosmetic compact as shown in FIGS. 44*a* and 44*b;*
Figure 63:
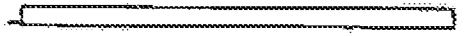
FIG. 63 is a front view of the mirror frame of the cosmetic compact as shown in FIGS. 44*a* and 44*b;*

As shown in FIGS. 62-64, the mirror frame 416 can be shaped as a rectangle but other shapes are contemplated. The mirror frame 416 can includes four sides 416*a-d*, mirror opening 418, and indents 417*a-b*.

Figure 65:
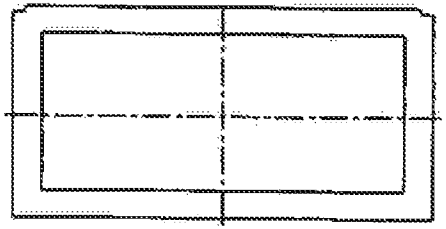
FIG. 65 is a top view of the top panel of the cosmetic compact as shown in FIGS. 44*a* and 44*b;*
Figure 67:
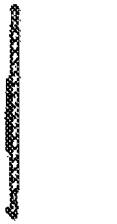
FIG. 67 is a side view of the top panel of the cosmetic compact as shown in FIGS. 44*a* and 44*b;*
Figure 66:
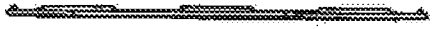
FIG. 66 is a front view of the top panel of the cosmetic compact as shown in FIGS. 44*a* and 44*b;*
Figure 81:
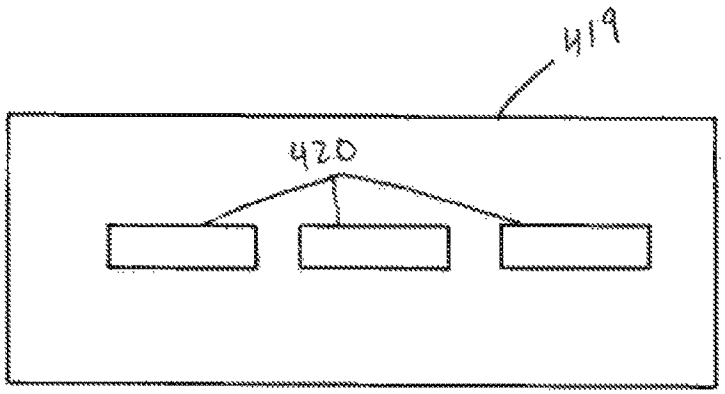
FIG. 81 is a top view of the inner spine wrap of the cosmetic compact as shown in FIGS. 44*a* and 44*b;*
Figure 80:
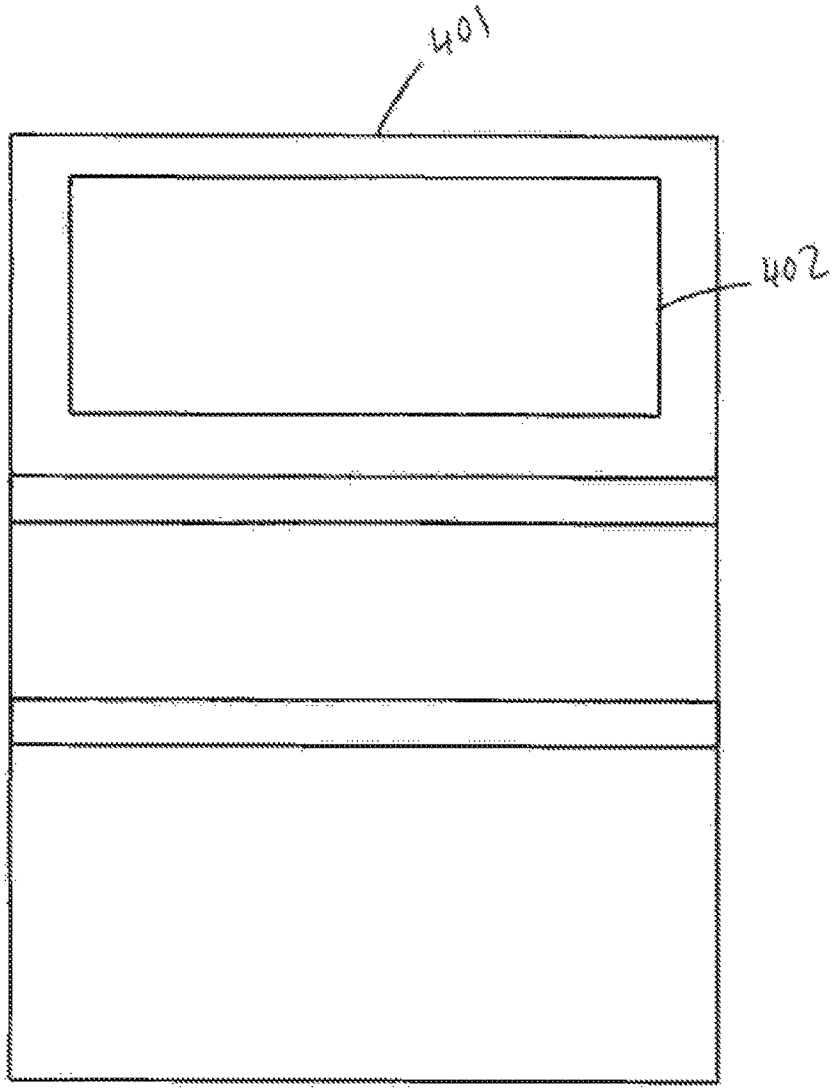
FIG. 80 is a top view of the outer wrap material of the cosmetic compact as shown in FIGS. 44*a* and 44*b;*
Figure 82:
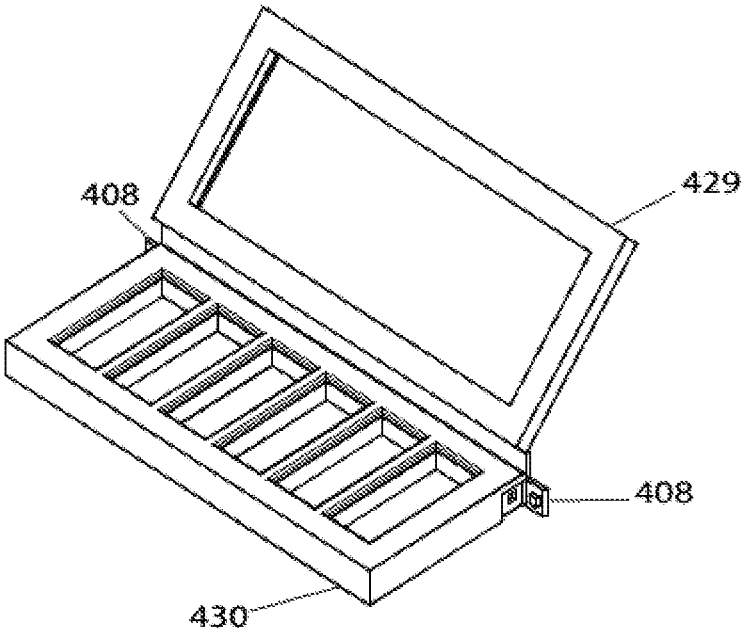
FIG. 82 is a prospective view of the of the cosmetic compact as shown in FIGS. 44*a* and 44*b* with extensions in an unlocked position.
Figure 83:
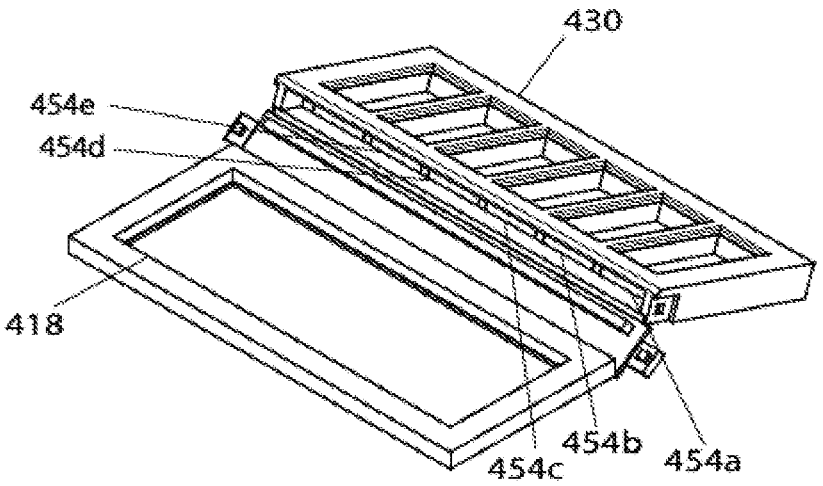
FIG. 83 is a prospective view of the of the cosmetic compact as shown in FIGS. 44*a* and 44*b* with spine in an open position.
Figure 84:
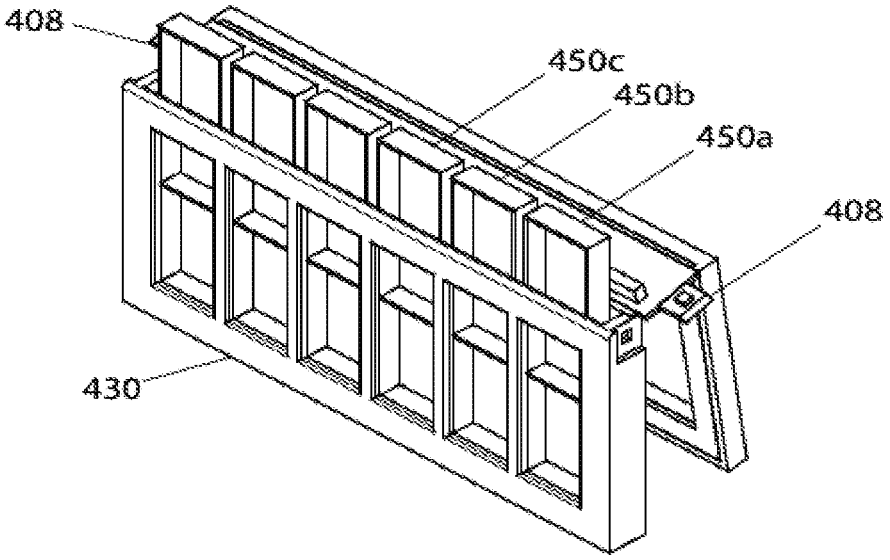
FIG. 84 is a prospective view of the of the cosmetic compact as shown in FIGS. 44*a* and 44*b* with pans being inserted into the base.

As shown in FIGS. 65-67, the top panel 405 can have a complementary shape to that of the mirror frame 416 as the top panel 405 will be received by the mirror frame 416 to form the cover 29 of the cosmetic compact 400. The top panel 405 can include edges 5*a-d* and sealing seams 6*a-d*. When the mirror frame 416 and the top panel 405 are adhered together they form the cover 429. In some implementations, sides 16*a*, 16*c* can have indents 417*a-b* for partially receiving the extensions 408*a-b* of the spine 407 when in a locked position.

The mirror frame 416 can be formed with an opening 418 for receiving a mirror 460. The mirror 460 can be placed within the opening 418 and in some cases adhered to the top panel 405 with an adhesive; however, other attachment methods are contemplated.

The mirror frame 416 and the platform 421 can be fitted with magnets 425, 426. Magnets 425 can be secured to the mirror frame 416 within recesses located on the mirror frame 416 and magnets 426 can be secured to the platform 421 within recesses on a ledge of the platform 421. The magnets can be attached with heat melt glue, but other securement methods are contemplated. These magnets 425, 426 are capable of magnetically securing the compact 400 in a closed position when not in use. It also allows the mirror frame 416 and the platform 421 to provide a tight fit of contact for the cosmetic compact 400 when in a closed position so that cosmetic material does not escape the cosmetic compact 400 when not in use. In some implementations, a protective cover 427 (FIGS. 44*a* and 44*b*), e.g., a polyethylene terephthalate (pet) disc, low density polyethylene (LDPE) disc, wax paper or other materials can be applied over the platform 421 to seal or protect cosmetic material stored within the base 430.

In some implementations, as shown in FIG. 68-75, the spine 407 can include extensions 408*a-b*, protrusions 409 and pressure tabs 410. The spine 407 partially forms a hinge 436 allowing the cover 429 to be rotated and magnetically sealed to the base 430.

That is, the extensions 408*a-b* are bendable at creases 458*a-b* and can wrap around the sides of the base 430 and the protrusions 409, which can be, e.g., snap-in/snap-out connectors, can be locked into the receivers 452*a-b* of the platform 421. Additionally, the spine 407 can be adhered to an inner spine wrap 419 using an adhesive. In some implementations, the inner spine wrap 419 can include openings 420 for receiving the pressure tabs of the spine.

Figure 45:
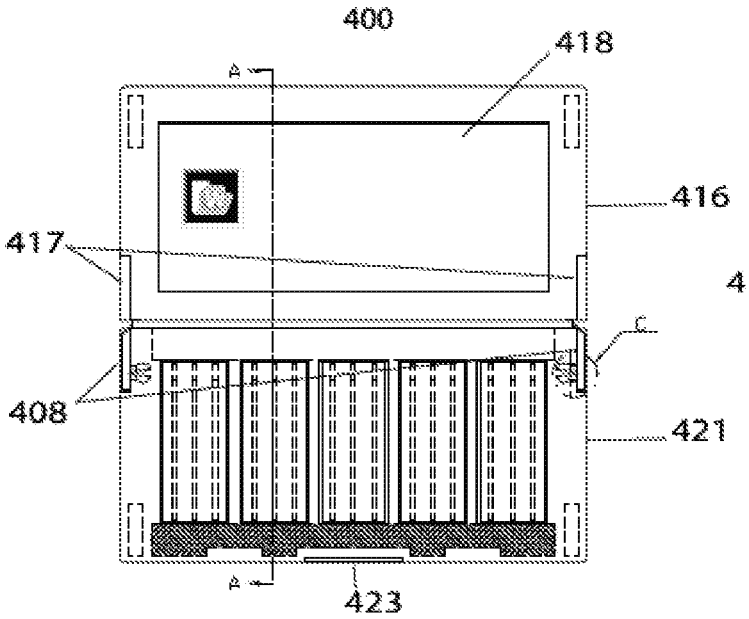
FIG. 45 is a top view of the cosmetic compact as shown in FIGS. 44*a* and 44*b* in an opened position.
Figure 46:
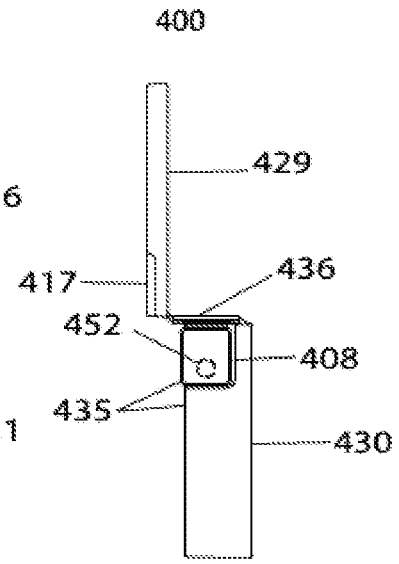
FIG. 46 is a side view of the cosmetic compact as shown in FIGS. 44*a* and 44*b* in an opened position.
Figure 47:
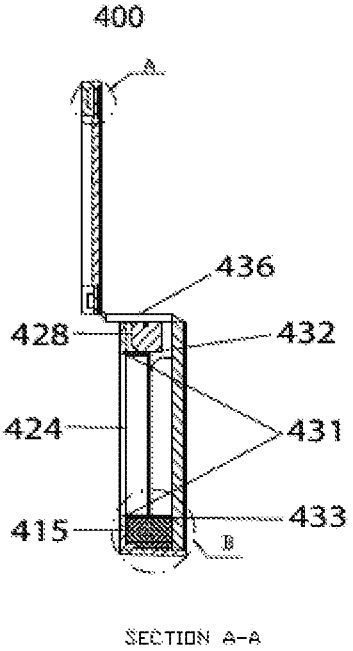
FIG. 47 is a cross-sectional view of the cosmetic compact as shown in FIG. 46.
Figure 48:
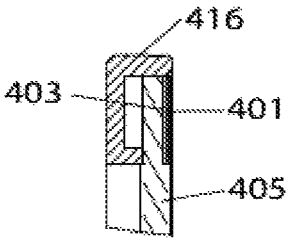
FIG. 48 is a close-up, cross-sectional view of the cosmetic compact as shown in Section A, FIG. 47.
Figure 49:
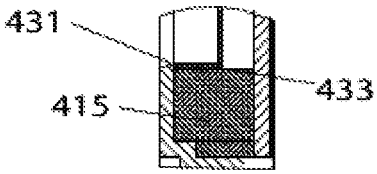
FIG. 49 is a close-up, cross-sectional view of the cosmetic compact as shown in Section B, FIG. 47.
Figure 50:
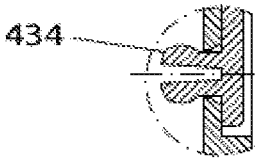
FIG. 50 is a close-up, cross-sectional view of the cosmetic compact as shown in Section C, FIG. 45.
Figure 55:
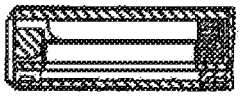
FIG. 55 is a cross-sectional view of the cosmetic compact as shown in FIG. 54.
Figure 54:
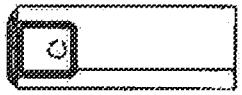
FIG. 54 is a side view of the cosmetic compact as shown in FIGS. 44*a* and 44*b* in a closed position.
Figure 53:
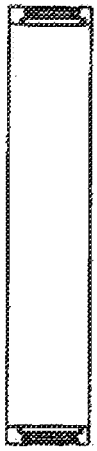
FIG. 53 is a back view of the cosmetic compact as shown in FIGS. 44*a* and 44*b* in a closed position.
Figure 51:
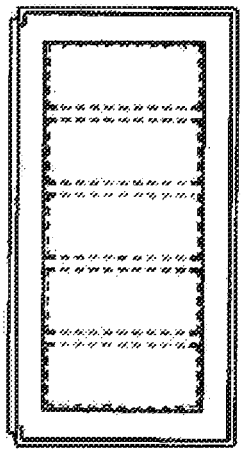
FIG. 51 is a top view of the cosmetic compact as shown in FIGS. 44*a* and 44*b* in a closed position.
Figure 52:
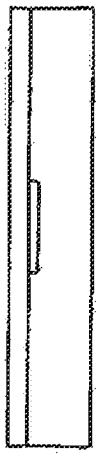
FIG. 52 is a front view of the cosmetic compact as shown in FIGS. 44*a* and 44*b* in a closed position.

In some implementations, the spine 407 and an outer spine wrap 403 can be laminated together, and then adhered to the outer wrap material 401 thereby partially forming the hinge 436, as shown in FIGS. 45-47. The hinge 436 can be connected between the cover 429 and the base 430 with an adhesive so that the cover 429 and the base 430 are bridged together by the hinge 436. This innovation allows the combination of injection parts and wraps to create the hinge 436. The hinge 436 allows the cosmetic compact 400 to open to, e.g., 180 degrees (FIGS. 45-47). The inner spine wrap 419 and outer spine wraps can be formed from a paper material but other materials, e.g., plastics, polyurethane (PU), fabrics, metals, foils are contemplated.

In some implementations, the outer wrap material 401 (FIGS. 44*a*, 44*b* and 80) can be formed from, e.g., paper, plastics, polyurethane (PU), fabrics, metals, or foils. The outer wrap material 401 can be adhered to an outer surface of the cover 429, the base 430 and the hinge 436, as a single piece. In other implementations, the outer wrap material 401 can be adhered in one or more pieces. The outer wrap material 401 can be decorated with a logo 402 for marketing and advertising purposes.

In some implementations, the outer wrap material 401 can be pre-cut to size so that it has the same width as the top panel 405, bottom panel 411 and spine 407 (minus the extensions). The outer wrap 401 can have a length to accommodate a combined length of the top panel 405, bottom panel 411 and spine 407. The outer wrap 401 can also have a space between the spine 407 and top panel 405 and a space between the spine 407 and bottom panel 411 wherein the spaces allows room for the cosmetic compact 400 to open and close.

During assembly, the top panel 405, the spine 407 and the bottom panel 411 can be glued to the outer wrap material 401 with an adhesive. Step 1. Magnets 425 and magnets 426 can be glued to the platform 421 and mirror frame 416, respectively. Step 2.

The outer spine wrap 403 can be glued over the spine 407. Step 3. (In some implementations, the spine wrap 403 and spine 407 can be adhered to each other in a separate step and the combination can be glued to the outer wrap material 401 as a single piece.)

The platform 421 can be adhered to the bottom panel 411. Step 4. More specifically, the bottom panel 411 can be placed within the sidewalls of the platform 421 so that the sidewalls 8*a-c* hide the edges of the bottom panel 411 and the edges of the outer wrap material 401. This placement allows the sealing seams 412 to be adjacent and touching the walls of platform 421. A sonic weld can then be performed to weld sealing seams 412 to the platform 421. Other adhesive mechanisms are contemplated, e.g., adhesives.

The mirror frame 416 can be adhered to the top panel 405. Step 5. More specifically, the top panel 12 can be placed within the sidewalls 16*a-d* of mirror frame so that the sidewalls 16*a-d* hide the edges of the top panel 405 and the edges of the outer wrap material 401. This placement allows sealing seams 6*a-d* to be adjacent and touching the sidewalls 9*a-d* of mirror frame 416 so that a sonic weld can be performed to weld sealing seams 6*a-d* to the sidewalls 9*a-d* of mirror frame 416. Please note, steps 3-5 can be done one at time or simultaneously.

The mirror 460 can be adhered within the mirror frame 416 with the soft block in place. (Step 6). Once assembled, the pans 450*a-e* can be loaded into the platform 421. The spine can be moved into a locked position so that the protrusions 409 of the spine 407 can be locked into the receivers 452 and a protective cover 432 can be placed over the platform 421 (Step 7). Once these steps (Steps 1-7) are completed, the cosmetic compact can be folded closed and packaged for shipping. Please note, that the order of these steps are for illustrative purposes as these steps can be performed in several different orders and combinations.

While presently preferred embodiments have been described for purposes of the disclosure, numerous changes in the arrangement can be made by those skilled in the art. Such changes are encompassed within the spirit of the invention.

The foregoing Detailed Description is to be understood as being in every respect illustrative and exemplary, but not restrictive, and the scope of the disclosed technology disclosed herein is not to be determined from the Detailed Description, but rather from the claims as interpreted according to the full breadth permitted by the patent laws. It is to be understood that the embodiments shown and described herein are only illustrative of the principles of the disclosed technology and that various modifications may be implemented by those skilled in the art without departing from the scope and spirit of the disclosed technology. Those skilled in the art could implement various other feature combinations without departing from the scope and spirit of the disclosed technology. Although the embodiments of the present disclosure have been described with specific examples, it is to be understood that the disclosure is not limited to those specific examples and that various other changes, combinations and modifications will be apparent to one of ordinary skill in the art without departing from the scope and spirit of the disclosed technology.

The invention claimed is:

1. A cosmetic compact comprising:

a hinge, the hinge including a spine having at least two extensions and at least two protrusions extending from the at least two extensions;

a base, the base including at least two receivers and at least one opening configured to receive at least one pan; and a cover, wherein the cover and the base are connected to one another via the hinge, wherein, in a locked position, the extensions are configured to wrap around the base and the at least two protrusions are configured to be removably locked into the at least two receivers thereby securing the at least one pan within the at least one opening, and wherein, in an unlocked position, the at least two protrusions are configured to be removed from the at least two receivers thereby providing access to the at least one opening.

2. The cosmetic compact of claim 1 further comprising:

an outer wrap material, wherein the cover, the base and the spine are affixed to the outer wrap material.

3. The cosmetic compact of claim 2 wherein the outer wrap material has a length greater than a length of the cover, the base and the spine.

4. The cosmetic compact of claim 3 wherein spacing is created between (1) the cover and the spine and (2) the base and the spine.

5. The cosmetic compact of claim 4 wherein the spacing allows the hinge to movably connect the base to the cover.

6. The cosmetic compact of claim 1 wherein the hinge further includes an outer spine wrap, wherein the outer spine wrap is adhered to the spine.

7. The cosmetic compact of claim 1 wherein the hinge further includes an inner spine wrap, wherein the inner spine wrap is adhered to the spine.

8. The cosmetic compact of claim 1 wherein the cover and the base include magnets for magnetically securing the cover to the base when the cosmetic compact is in a closed position.

9. The cosmetic compact of claim 1 wherein the base includes a platform and a bottom panel that are adhered to one another to form the base.

10. The cosmetic compact of claim 1 wherein the platform includes well openings.

11. The cosmetic compact of claim 1 wherein the bottom panel includes dividers, the dividers forming individual compartments for the at least one pan.

12. The cosmetic compact of claim 1 wherein the bottom panel includes ridges for raising the at least one pan.

13. The cosmetic compact of claim 1 wherein the base includes a soft block for limiting movement of the at least one pan when loaded and locked into the base.

14. The cosmetic compact of claim 1 wherein the base includes a hard block for limiting movement of the at least one pan when loaded and locked into the base.

15. The cosmetic compact of claim 1 wherein the cover includes a frame and a top panel that are adhered to one another to form the cover.

16. The cosmetic compact of claim 1 wherein the cover further includes a mirror.

* * * * *